US007179143B2

(12) United States Patent
Mizuguchi et al.

(10) Patent No.: US 7,179,143 B2
(45) Date of Patent: Feb. 20, 2007

(54) OUTBOARD MOTOR STEERING SYSTEM

(75) Inventors: Hiroshi Mizuguchi, Wako (JP); Hideaki Takada, Wako (JP); Taiichi Otobe, Wako (JP); Yoshinori Masubuchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/780,065

(22) Filed: Feb. 18, 2004

(65) Prior Publication Data

US 2004/0224581 A1 Nov. 11, 2004

(30) Foreign Application Priority Data

Feb. 19, 2003 (JP) ..... 2003-040833
Feb. 19, 2003 (JP) ..... 2003-040834
Feb. 19, 2003 (JP) ..... 2003-040836

(51) Int. Cl.
*B63H 5/125* (2006.01)

(52) U.S. Cl. ..... 440/615

(58) Field of Classification Search ..... 137/115.08, 137/115.11; 114/151, 150; 440/615, 53, 440/58–60, 61 R
See application file for complete search history.

(56) References Cited

U.S. PATENT DOCUMENTS 3,084,657 A * 4/1963 Kiekhaefer ..... 440/52
4,545,770 A * 10/1985 Ferguson ..... 440/61 R
5,190,488 A * 3/1993 Fujimoto ..... 440/53
6,155,797 A * 12/2000 Kazuyoshi ..... 417/220
2003/0109184 A1* 6/2003 Kanno ..... 440/1
2004/0173734 A1* 9/2004 Alsobrooks et al. ... 250/231.13

FOREIGN PATENT DOCUMENTS

JP 61-263897 11/1986
JP 62-125996 6/1987
JP 62-166193 7/1987
JP 62-231896 10/1987
JP 1-116795 8/1989

(Continued)

OTHER PUBLICATIONS

Japanese Office Action dated Dec. 13, 2005.

*Primary Examiner*—Ed Swinehart
(74) *Attorney, Agent, or Firm*—Westerman, Hattori, Daniels & Adrian, LLP.

(57) ABSTRACT

An outboard motor steering system for an outboard motor mounted on a stern of a boat and having an internal combustion engine and a propeller with a rudder powered by the engine to propel and steer the boat. The system includes a swivel shaft connected to the propeller, a swivel case rotatably accommodating the swivel shaft, and a hydraulic cylinder connected to the swivel shaft to rotate it. The swivel case is formed with a box-like recess to accommodate the hydraulic cylinder therein such that the hydraulic cylinder does not project outside a profile of the outboard motor, regardless of a steered angle of the outboard motor. A rotation angle sensor is also installed in the recess and outputs a signal indicative of an angle of swivel shaft rotation. Further, moving orifices are provided in a hydraulic pressure circuit of the actuator for relieving excessive hydraulic pressure. Thus, space utilization around the outboard motor and boat is not restricted and steering feel is improved.

15 Claims, 17 Drawing Sheets

FOREIGN PATENT DOCUMENTS

| | | |
|---|---|---|
| JP | 1-179098 | 12/1989 |
| JP | 02-279495 | 11/1990 |
| JP | 06-127475 | 5/1994 |
| JP | 10-185621 | 7/1998 |
| JP | 2000-121309 | 4/2000 |
| JP | 2002-022487 | 1/2002 |

* cited by examiner

OUTBOARD MOTOR STEERING SYSTEM

BACKGROUND OF THE INVENTION

1. Field of the Invention

This invention relates to an outboard motor steering system.

2. Description of the Related Art

Almost all outboard motor steering systems have up to now been of types operated by human power, such as the tiller handle type used to turn the rudder by manually operating the tiller handle attached to the outboard motor and the remote control type used to remotely operate a steering mechanism through a push-pull cable in response to rotation of a steering wheel manipulated by the operator.

Since human-powered steering systems are disadvantageous because they tend to have an unpleasant steering "feel" owing to, for instance, heavy steering load, as taught in Japanese Laid-Open Patent Application Sho 62 (1987)-125996, an add-on mechanism constituted as a separate unit from the outboard motor and used to power-assist the turning of the steering wheel is known. This mechanism typically includes a steering actuator such as a hydraulic cylinder placed on the boat to power-assist the steering through a link mechanism.

Also, as taught in Japanese Laid-Open Patent Application Sho 62 (1987)-166193 ('193), another add-on mechanism similarly constituted as a separate unit from the outboard motor and used to power-assist the turning of the steering wheel is known. This mechanism includes a hydraulic cylinder placed on the boat and is connected to the swivel shaft through an arm. In the system mentioned in '193, a rotation angle sensor is installed at the boat to detect the angle of arm rotation, and the hydraulic cylinder is operated to decrease an error between the angle of steering wheel rotation inputted by the operator and the detected angle of arm rotation such that the boat is steered as desired by the operator.

The add-on steering system using such an actuator also has disadvantages, most notably that its structure is complicated, that it adds to the number and weight of the components, and that it takes up space around the boat.

Attempts have been made to overcome these drawbacks. Japanese Laid-Open Patent Application No. Hei 2(1990)-279495 ('495), for example, teaches a steering system including a steering actuator that is not attached to the boat, but directly attached to the outboard motor, thereby minimizing increase in the number and weight of the constituent components and saving space.

Aside from the above, the add-on steering system using a hydraulic cylinder, as taught in Japanese Laid-Open Patent Application No. Hei 6 (1994)-127475 ('475), typically includes a hydraulic pump, an electric motor for driving the pump and a switch valve installed in a hydraulic pressure circuit for switching the direction of oil flow, etc.

However, the steering system taught by '193 is disadvantageous from the aspect of saving space around the boat, since it needs the rotation angle sensor to be installed at the boat to detect the angle of rotation of the arm that connects the hydraulic cylinder to the swivel shaft.

Further, the steering system taught by '495 is disadvantageous from the aspect of saving space around the outboard motor because in some operating states of the hydraulic cylinder, the hydraulic cylinder projects from the outboard motor in the horizontal direction. This is serious in particular when two outboard motors are installed side by side in a dual motor configuration, the installation space must be enlarged by the amount of projection of the actuator so as to prevent interference between the outboard motors.

Further, the steering system taught by '193 is disadvantageous from the aspect of steering feel, since it needs the angle of arm rotation to be detected, if the arm is distorted or deformed. The sensor value does not detect the angle of rotation of the swivel shaft accurately and hence, it becomes difficult to operate the hydraulic cylinder to achieve steering as desired.

Further, the steering system taught by '475 is also disadvantageous from the aspect of steering feel, since, when the operator operates the electric motor to drive the hydraulic pump with the intention of turning the boat in an opposite direction, the boat can not change the direction due to inertia force exerting thereon. For this reason, in particular when the boat is intended to turn quickly, hydraulic pressure rises sharply and generates a large reaction force that will act on the electric motor. Since this reaction force is transmitted to the hydraulic cylinder and other parts as an impact, it occasionally becomes difficult to turn the boat smoothly, thereby degrading the steering feel.

SUMMARY OF THE INVENTION

An object of the present invention is therefore to overcome the foregoing issues by providing an outboard motor steering system having a steering actuator that power-assists the steering in which space utilization around the outboard motor and boat is not restricted by the actuator and the like, while enabling to improve steering feel.

In order to achieve the foregoing objects, this invention provides, in its first aspect, a steering system for an outboard motor mounted on a stern of a boat and having an internal combustion engine at its upper portion and a propeller with a rudder at its lower portion powered by the engine to propel and steer the boat, comprising: a swivel shaft connected to the propeller to turn the propeller relative to the boat; an actuator connected to the swivel shaft to rotate the swivel shaft; and a swivel case rotatably accommodating the swivel shaft, the swivel case being formed with a recess having a box-like shape to accommodate the actuator therein in such a manner that the actuator does not project outside a profile of the outboard motor, obtained by looking down the outboard motor from above in the vertical direction, regardless of a steered angle of the outboard motor.

In order to achieve the foregoing objects, this invention provides, in its second aspect, a steering system for an outboard motor mounted on a stern of a boat and having an internal combustion engine at its upper portion and a propeller with a rudder at its lower portion powered by the engine to propel and steer the boat, comprising: a swivel shaft connected to the propeller to turn the propeller relative to the boat; an actuator connected to the swivel shaft to rotate the swivel shaft; a rotation angle sensor installed around an outer periphery of the swivel shaft and outputting a signal indicative of an angle of rotation of the swivel shaft; and a controller that controls operation of the actuator based on at least the signal of the rotation angle sensor.

In order to achieve the foregoing objects, this invention provides, in its third aspect, a steering system for an outboard motor mounted on a stern of a boat and having an internal combustion engine at its upper portion and a propeller with a rudder at its lower portion powered by the engine to propel and steer the boat, comprising: a swivel shaft connected to the propeller to turn the propeller relative to the boat; a hydraulic actuator connected to the swivel shaft to rotate the swivel shaft; a hydraulic pressure supplier that supplies hydraulic pressure to the hydraulic actuator; and a hydraulic pressure reliever that relieves hydraulic pressure when change of hydraulic pressure of the hydraulic pressure supplier exceeds a predetermined value.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

An outboard motor steering system according to embodiments of the present invention will now be explained with reference to the attached drawings.

Figure 1:
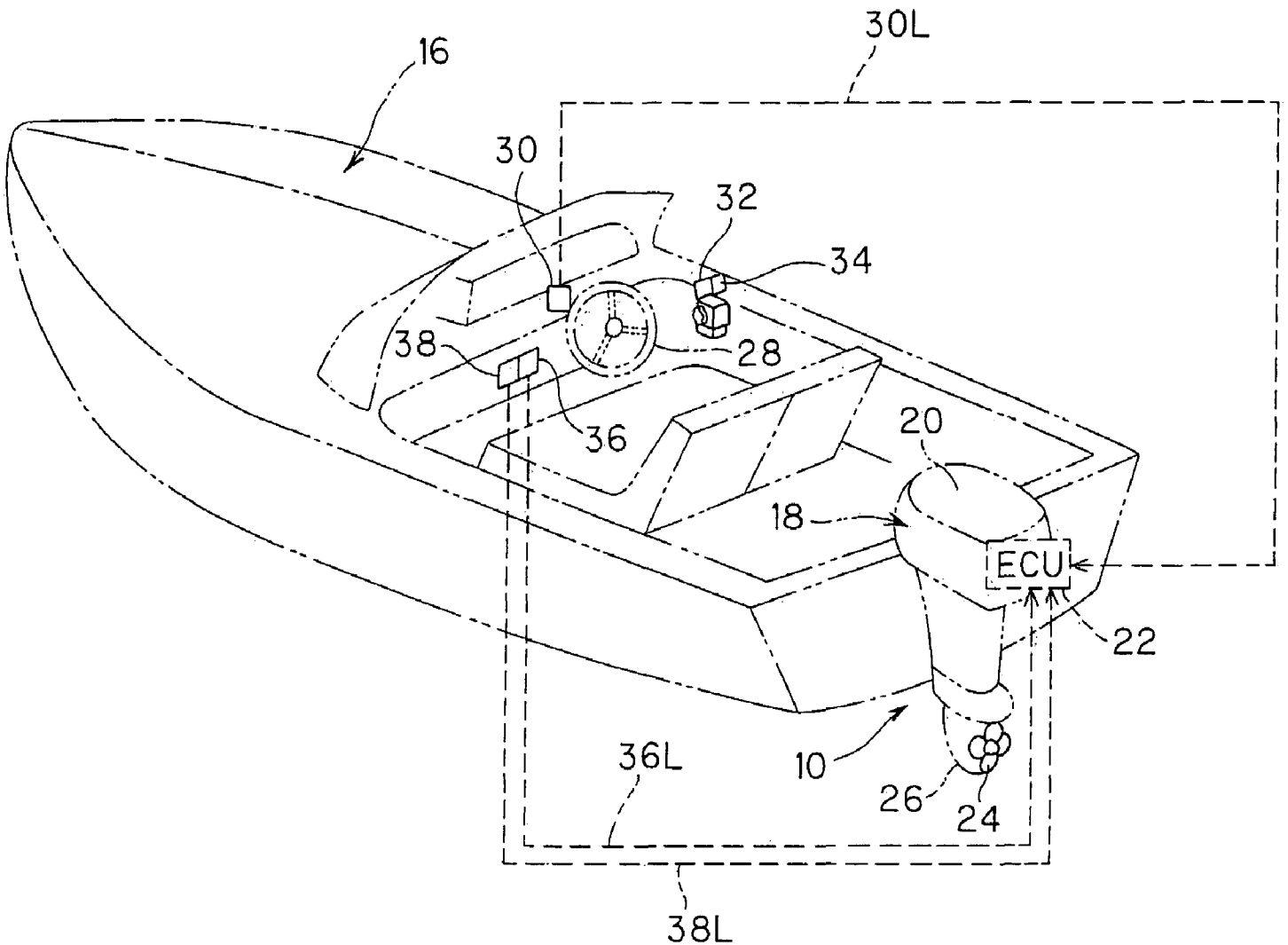
FIG. 1 is an overall schematic view of an outboard motor steering system according to a first embodiment of the invention.
Figure 2:
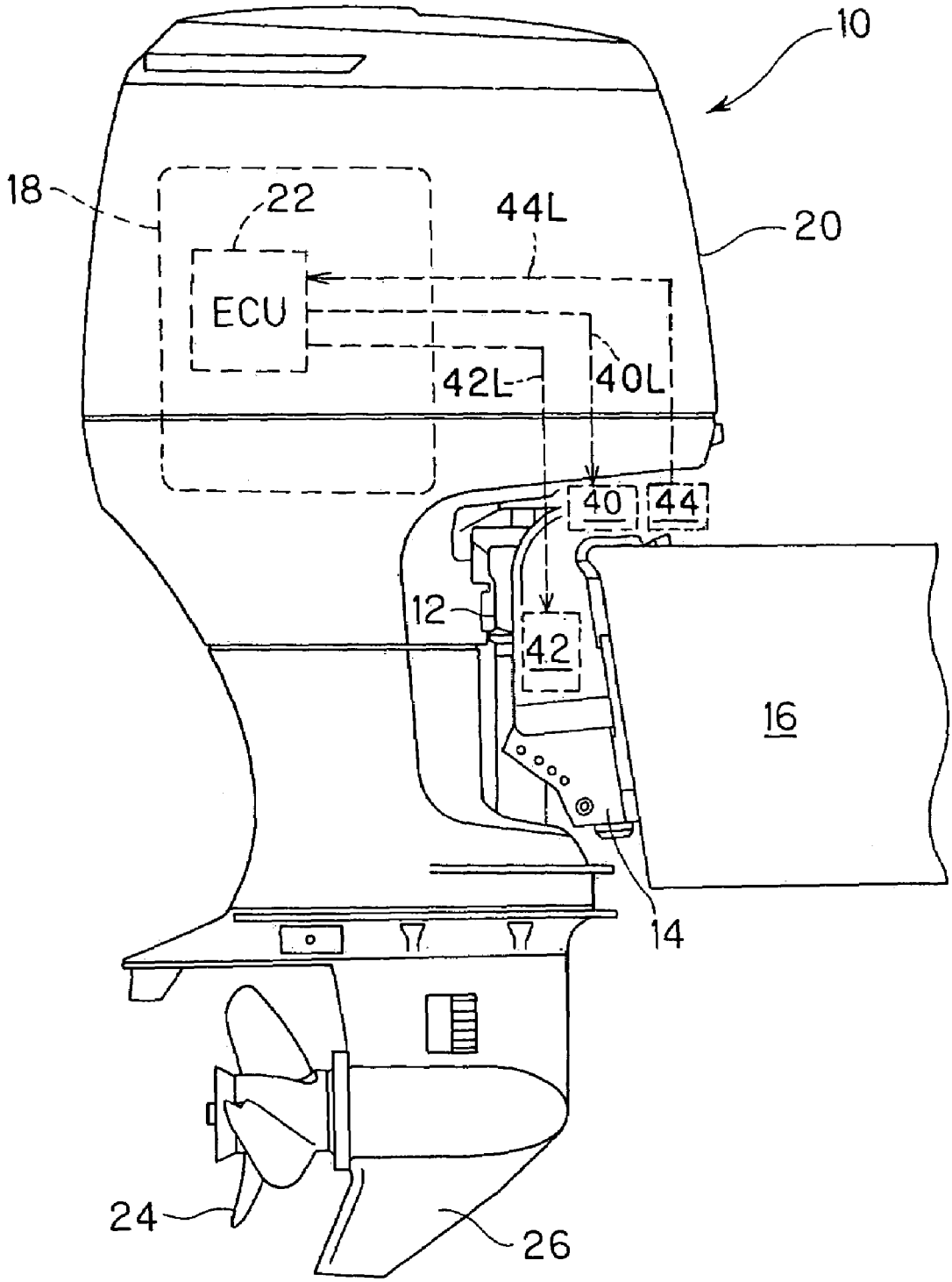
FIG. 2 is an enlarged side view of an outboard motor illustrated FIG. 1.

FIG. 1 is an overall schematic view of the outboard motor steering system according to a first embodiment of the invention, and FIG. 2 is an enlarged side view of an outboard motor illustrated in FIG. 1.

Reference numeral 10 in FIGS. 1 and 2 designates an outboard motor built integrally of an internal combustion engine, propeller shaft, propeller and other components. As illustrated in FIG. 2, the outboard motor 10 is mounted on the stern of a boat (hull) 16 via a swivel case 12 (that rotatably accommodates or houses a swivel shaft (not shown)) and stern brackets 14 (to which the swivel case 12 is connected), to be rotatable about the vertical and horizontal axes.

As shown in FIG. 2, the outboard motor 10 is equipped with an internal combustion engine 18 at its upper portion. The engine 18 is a spark-ignition, in-line four-cylinder gasoline engine with a displacement of 2,200 cc. The engine 18, located inside the outboard motor 10, is enclosed by an engine cover 20 and positioned above the water surface. An electronic control unit (ECU) 22 constituted of a microcomputer is installed near the engine 18 enclosed by the engine cover 20.

The outboard motor 10 is equipped at its lower part with a propeller 24 and a rudder 26 adjacent thereto. The rudder 26 is fixed near the propeller 24 and does not rotate independently. The propeller 24, which operates to propel the boat 16 in the forward and reverse directions, is powered by the engine 18 through a crankshaft, drive shaft, gear mechanism and shift mechanism (none of which is shown).

As shown in FIG. 1, a steering wheel 28 is installed near the operator's seat of the boat 16. A steering angle sensor 30 is installed near the steering wheel 28. The steering angle sensor 30 is made of a rotary encoder and outputs a signal in response to the turning (rotation) of the steering wheel 28 inputted by the operator. A throttle lever 32 and a shift lever 34 are mounted on the right side of the operator's seat. Operations inputted to these are transmitted to a throttle valve of the engine 18 and the shift mechanism (neither shown) through push-pull cables (not shown).

A power tilt switch 36 for regulating the tilt angle and a power trim switch 38 for regulating the trim angle of the outboard motor 10 are also installed near the operator's seat. These switches output signals in response to tilt-up/down and trim-up/down instructions inputted by the operator. The outputs of the steering angle sensor 30, power tilt switch 36 and power trim switch 38 are sent to the ECU 22 over signal lines 30L, 36L and 38L.

As shown in FIG. 2, a steering actuator, more specifically a steering hydraulic cylinder 40 to power-assist the steering and a conventional power tilt-trim unit 42 to regulate the tilt angle and trim angle of the outboard motor 10 are installed around the swivel case 12 and the stern brackets 14 and are connected to the ECU 22 through signal lines 40L and 42L. A rotation angle sensor 44 is installed at a location near the hydraulic cylinder 40 and outputs a signal indicative of the angle of rotation of a swivel shaft (not shown) accommodated in the swivel case 12. The output of the rotation angle sensor 44 is sent to the ECU over signal line 44L.

In response to the outputs of the sensors and switches, the ECU 22 operates the hydraulic cylinder 40 to steer the outboard motor 10, i.e., change the direction of the propeller 24 and rudder 26, and thereby turn the boat 16 right or left. In response to the outputs of the power tilt switch 36 and power trim switch 38 sent over the signal lines 36L, 38L, it also operates the power tilt-trim unit 42 to regulate the tilt angle and trim angle of the outboard motor 10.

Figure 3:
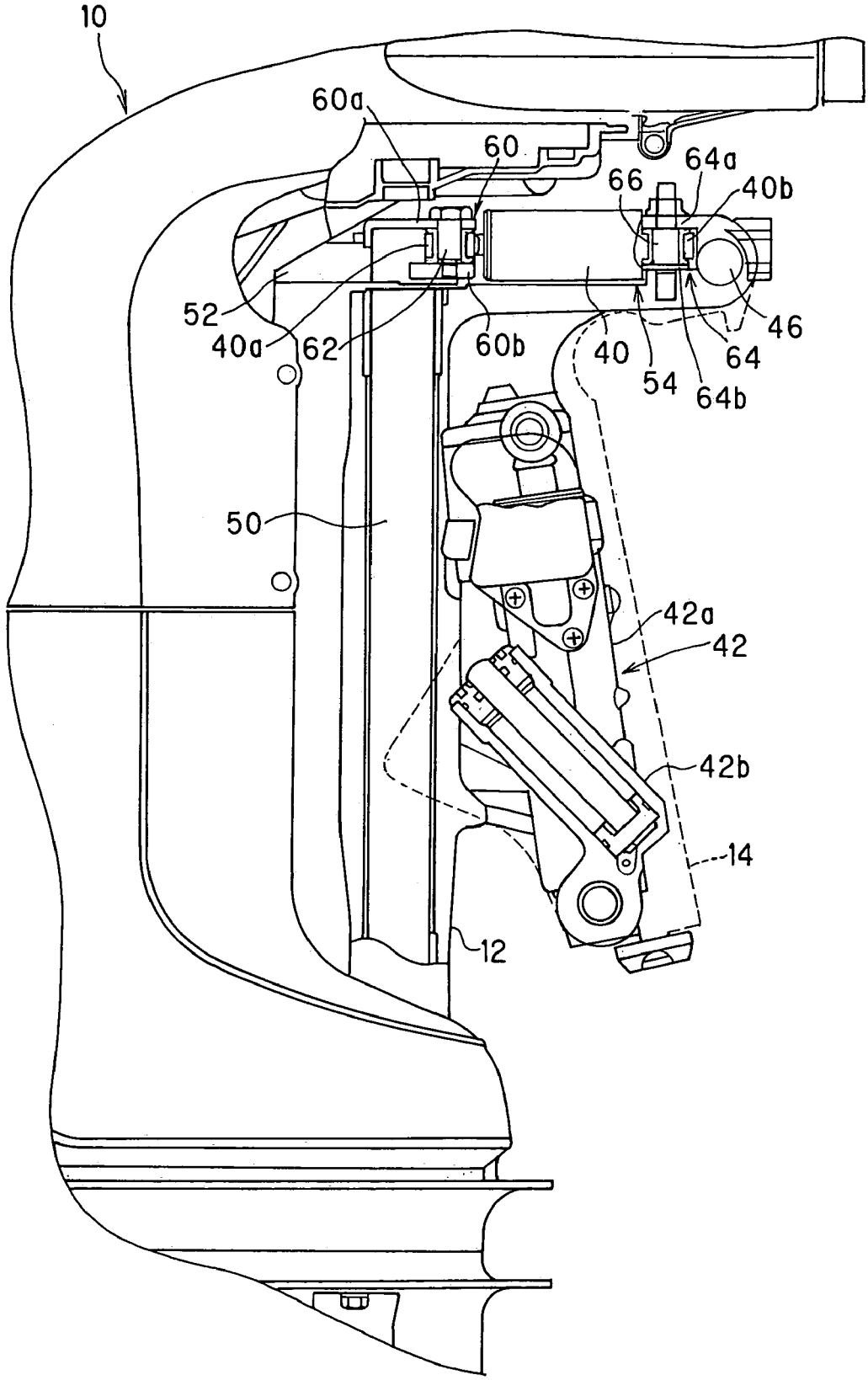
FIG. 3 is an enlarged partially cross-sectional side view of a swivel case (or thereabout) illustrated in FIG. 2.

FIG. 3 is an enlarged partially cross-sectional side view of a swivel case 12 (or thereabout) illustrated in FIG. 2.

As illustrated in FIG. 3, the power tilt-trim unit 42 is equipped with one hydraulic cylinder 42*a* for tilt angle regulation and, constituted integrally therewith, two hydraulic cylinders 42*b* for trim angle regulation (only one shown). One end (cylinder bottom) of the tilt hydraulic cylinder 42*a* is fastened to the stern brackets 14 and through it to the boat 16 and the other end (piston rod head) thereof abuts on the swivel case 12. One end (cylinder bottom) of each trim hydraulic cylinder 42*b* is fastened to the stern brackets 14 and through it to the boat 16, similarly to the one end of the tilt hydraulic cylinder 42*a*, and the other end (piston rod head) thereof abuts on the swivel case 12.

The swivel case 12 is connected to the stern brackets 14 through a tilting shaft 46 to be relatively displaceable about the tilting shaft 46. As mentioned above, the swivel shaft (now assigned with reference numeral 50) is rotatably accommodated inside the swivel case 12. The swivel shaft 50 extends in the vertical direction and has its upper end fastened to a mount frame 52 and its lower end fastened to a lower mount center housing (not shown). The swivel case 12 has an elongated cylindrical portion between the upper and lower ends that accommodates the swivel shaft coaxially. The mount frame 52 and lower mount center housing are fastened to a frame on which the engine 18 and the propeller 24, etc., are mounted.

Figure 4:
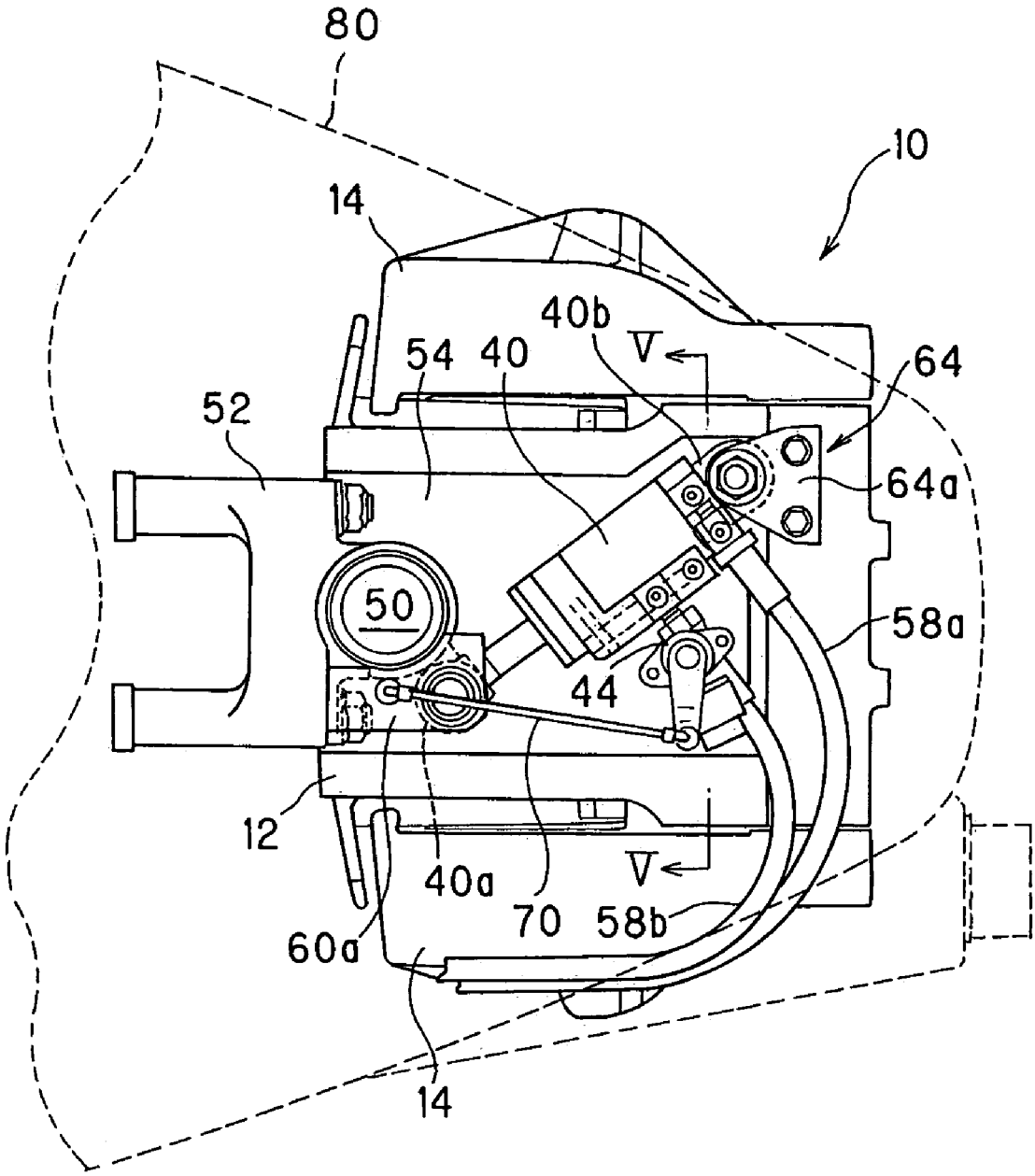
FIG. 4 is a plan view of the swivel case (or thereabout) viewed from the above.
Figure 5:
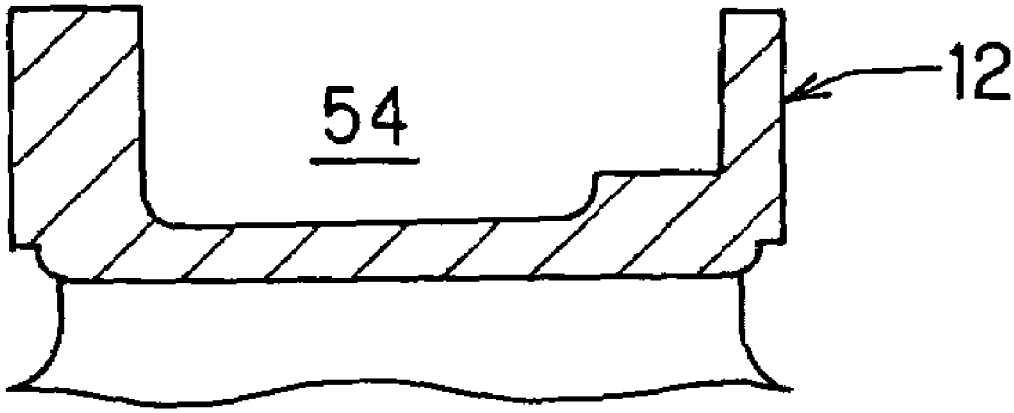
FIG. 5 is a cross-sectional view taken along the line V—V of FIG. 4.

FIG. 4 is a plan view of the swivel case 12 (or thereabout) viewed from the above and FIG. 5 is a cross-sectional view taken along the line V—V of FIG. 4.

As illustrated in FIGS. 3 to 5, the swivel case 12 is partially sunk at its top to form a recess 54 in which the steering hydraulic cylinder 40 is installed. Specifically, as illustrated in FIG. 4, the recess 54 has substantially a rectangular box-like shape to accommodate the hydraulic cylinder 40 therein in such a manner that the longitudinal direction of the cylinder 40 is positioned on a diagonal (joining opposite corners) of the rectangle (in plan view) of the recess 54. Specifically, the hydraulic cylinder 40 is a double-acting hydraulic cylinder and is connected a hydraulic pump (not shown) via two oil pipes 58*a* and 58*b* to be supplied with pressurized oil. In FIG. 5, for the brevity of illustration, the cylinder 40 and other parts are omitted.

Then, the installation of the hydraulic cylinder 40 will be explained.

A pair of stays (supports) 60 is fastened to the mount frame 52 at a position near the uppermost of the swivel shaft 50 and an output end of the hydraulic cylinder 40, i.e., a rod head 40*a* of a piston rod of the hydraulic cylinder 40 is rotatably fixed to the pair of stays 60 (hereinafter referred to as "output end side stays"). The output end side stays 60 comprises a first stay (first support) 60*a* (hereinafter referred to as "first output end side stay") that supports or carries an upper portion of the rod head 40*a* (more specifically an upper portion of an output end side cylindrical member 62 rotatably connected to the rod head 40*a*) and a second stay (second support) 60*b* (hereinafter referred to as "second output end side stay") that supports or carries a lower portion of the rod head 40*a* (more specifically a lower portion of the output end side cylindrical member 62). The first and second output end side stays 60*a* and 60*b* support or carry the rod head 40*a* of the hydraulic cylinder 40 at positions each spaced apart from the rotation axis of the swivel shaft 50 by a predetermined distance.

Similarly, a second pair of stays (supports) 64 is fixed to the swivel case 12 as supports at a position near the end (stern) of the boat 16 and a main body of the hydraulic cylinder 40, i.e., a cylinder bottom 40*b* of the hydraulic cylinder 40 is rotatably fixed to the second pair of stays 64 (hereinafter referred to as "main body side stays"). The main body side stays 64 comprises a first stay (first support) 64*a* (hereinafter referred to as "first main body side stay") that supports or carries the upper portion of the cylinder bottom 40*b* (more specifically an upper portion of a main body side cylindrical member 66 rotatably connected to the cylinder bottom 40*b*) and a second stay (second support) 64*b* (hereinafter referred to as "second main body side stay") that supports or carries the lower portion of the cylinder bottom 40*b* (more specifically a lower portion of the main body side cylindrical member 66).

Thus, the hydraulic cylinder 40 is installed in the recess 54 in such a way that, its rod head 40*a* is supported or carried by the output end side stays 60 to be connected to the mount frame 52 (that generates angular displacement in the horizontal direction relative to the boat 16), whilst its cylinder bottom 40*b* is supported or carried by the main body side stays 64 to be connected to the swivel case 12 (that generates no angular displacement in the horizontal direction relative to the boat 16).

As illustrated in FIG. 4, the rotation angle sensor 44 is installed inside the recess 54 at a position near a corner that is different from those joining the aforesaid diagonal, while keeping a distance from the swivel shaft 50. The rotation angle sensor 44 is connected to the first output end side stay 60*a* by a sensor rod 70, such that the angle of rotation of the swivel shaft 50 is transmitted to the rotation angle sensor 44 via the mount frame 52, the first output end side stay 60*a* and the sensor rod 70, thereby ensuring to detect the angle of swivel shaft rotation even when disposed at such a position as is separated from the swivel shaft 50.

In the steering system, when the operator steers the steering wheel 28, the amount of steering (rotation of the steering wheel 28) is detected by the steering angle sensor 30 and is inputted to the ECU 22. The output of the rotation angle sensor 44 mentioned immediately above is also inputted to the ECU 22. The ECU 22 determines or calculates a current supply command in such a manner that an error between the detected steering angle and the angle of swivel shaft rotation decreases to zero and outputs the same to a driver circuit of an electric motor (not shown) to drive a hydraulic pump through the hydraulic pressure circuit. With this, the hydraulic cylinder 40 extends or contracts to rotate the swivel shaft 50 such that the outboard motor 10 is steered.

Figure 6:
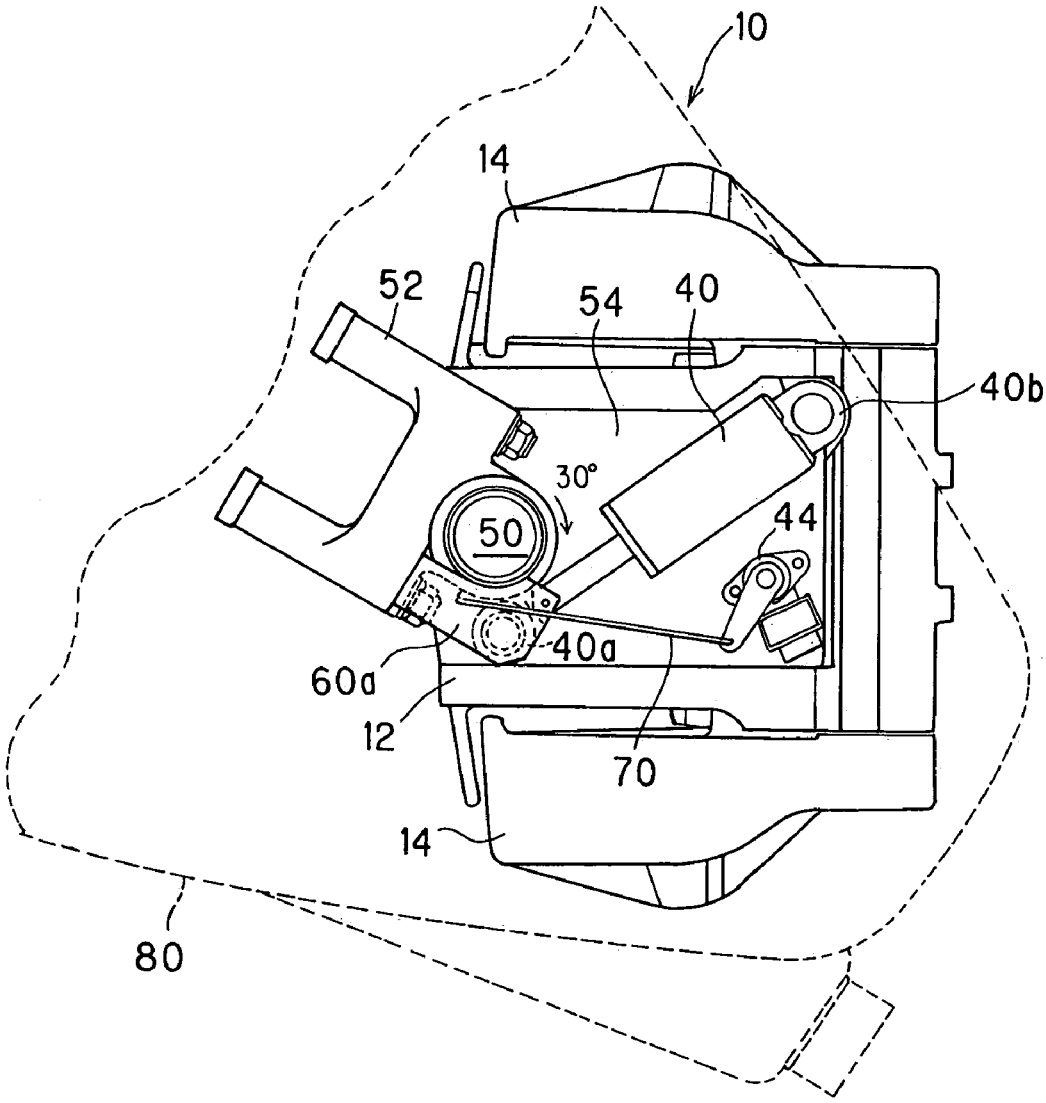
FIG. 6 is a view, similar to FIG. 4, but showing a positional relationship of the hydraulic cylinder etc., relative to a profile (the vertical projection plane) of the outboard motor, more specifically showing that when the outboard motor is steered (rotated) right at its maximum.
Figure 7:
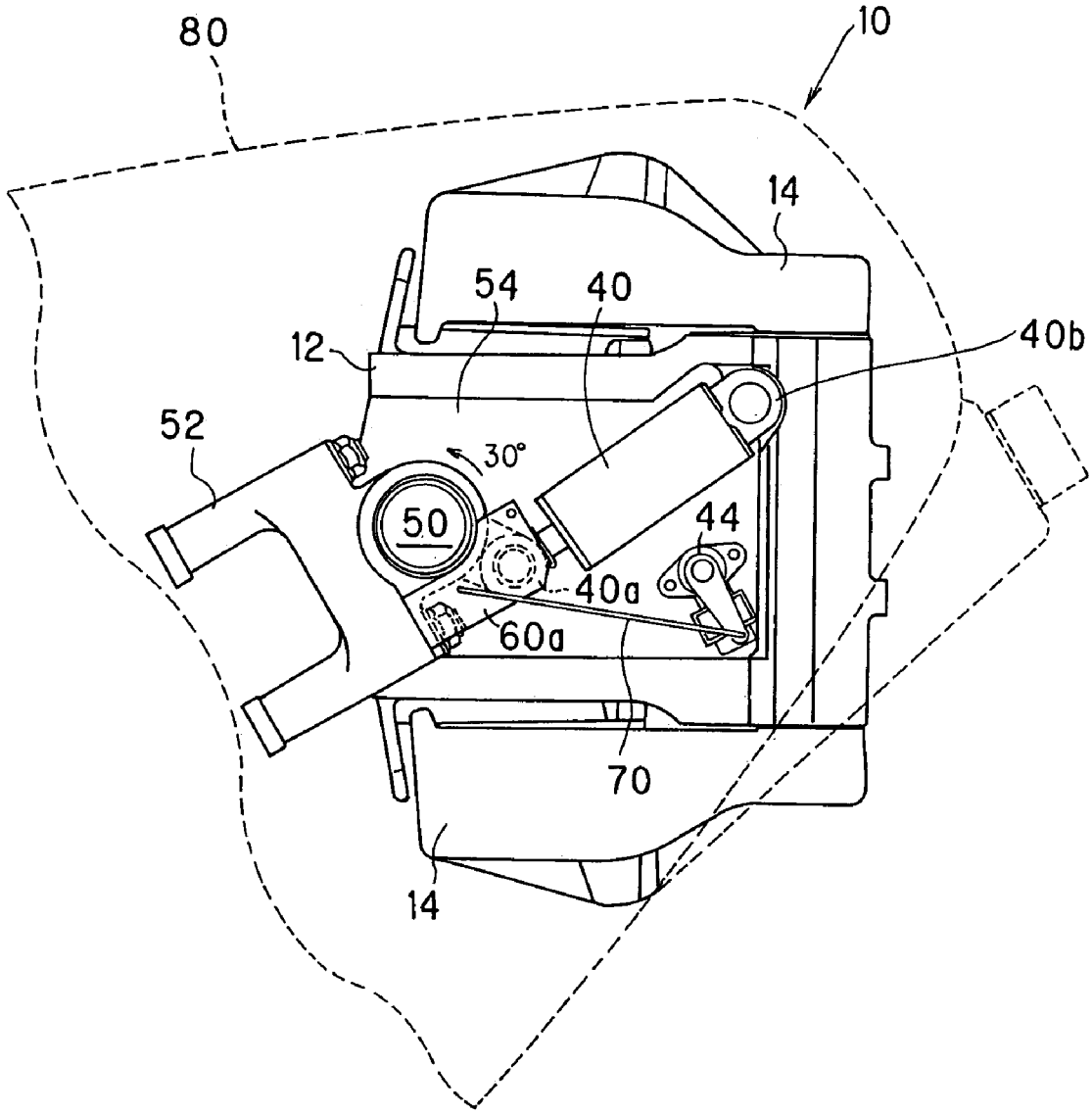
FIG. 7 is a view, similar to FIG. 6, but showing that when the outboard motor is steered (rotated) left at its maximum.

FIGS. 6 and 7 are views similar to FIG. 4, but showing a positional relationship of the hydraulic cylinder 40, etc., relative to a profile (the vertical projection plane and indicated by reference numeral 80) of the outboard motor 10, in which FIG. 6 illustrates that when the outboard motor 10 is steered (rotated) right at its maximum, whereas FIG. 7 illustrates that when the outboard motor 10 is steered (rotated) left at its maximum. In FIGS. 6 and 7, for ease of understanding, some parts are omitted from illustration.

As understood from the figures, by operating the hydraulic cylinder 40 to extend or contract, the steering of the outboard motor 10 in the horizontal direction about the swivel shaft 50 is power-assisted and the propeller 24 (and the rudder 26) is swung to steer the boat 16. Specifically, the swivel shaft 50 and mount frame 52 are rotated right (viewed from the above) relative to the boat 16 when the hydraulic cylinder 40 is operated to extend, and the outboard motor 10 is steered right such that the boat 16 is steered or turned left (viewed from the above) as shown in FIG. 6. On the contrary, when the hydraulic cylinder 40 is operated to contract, the swivel shaft 50 and mount frame 52 rotate left to steer the outboard 10 left such that the boat 16 is steered or turned right as shown in FIG. 7.

Further, as will be supposed from FIGS. 6 and 7, the overall steerable angle (rudder turning angle) of the outboard motor 10 is 60 degrees, 30 degrees to the right and 30 degrees to the left. Since, however, the hydraulic cylinder 40 is installed inside the recess 54 formed at the top of the swivel case 12, even when the outboard motor 10 is steered left or right at its maximum, in other words, regardless of a steered angle of the outboard motor 10, the hydraulic cylinder 40 does not project outside the profile 80 of the outboard motor 10 in the horizontal direction. Thus, space utilization around the outboard motor and boat is not restricted by the hydraulic cylinder 40.

As mentioned above, in the outboard motor steering system according to this embodiment, since the swivel shaft (steering shaft) 50 is rotated by the hydraulic cylinder 40, it becomes possible to lighten steering load and hence, to improve steering feel. Since the swivel case 12 (that houses the swivel shaft 50) is formed with the recess 54 of a box-like shape to accommodate the hydraulic cylinder 40 therein in such a manner that the hydraulic cylinder 40 does not project outside the profile 80 of the outboard motor 10, it becomes possible to prevent space utilization around the outboard motor and boat from being restricted. In addition, the recess 54 of a box-like shape can improve the strength of the swivel case 12.

Further, since the hydraulic cylinder 40 is installed in the recess 54 in such a manner that the longitudinal direction of the cylinder 40 is positioned on a diagonal (joining opposite corners) of the rectangle (in plan view) of the recess 54, it becomes possible to utilize the inner space of the recess 54 more effectively. This makes it possible to install a hydraulic cylinder of greater size, in other words, a hydraulic cylinder of a larger output. In the hydraulic cylinder 40, since the distance of piston stroke can be enlarged, it becomes possible to make the distance between the swivel shaft 50 and the rod head 40*a* (corresponding to the radius of swivel shaft rotation) and to increase its force of driving, while ensuring the maximum steerable angle of 60 degrees. In other words, it becomes possible to decrease the force necessary for rotating the swivel shaft 50. For this intention, the rod head 40*a* is not connected to the swivel shaft 50 directly, but is connected via the output end side stays 60.

Further, since the rotation angle sensor 44 is installed inside the recess 54 at a position near the corner that is different from those joining the aforesaid diagonal, it becomes possible to utilize the inner space of the recess 54 more effectively so as to take a lesser space.

Further, it is arranged such that, the output end side stays 60 (that carry the hydraulic cylinder 40 in the inner space of the recess 54) comprises the first output end side stay 60*a* that supports the upper portion of the rod head (output end) 40*a* and the second output end side stay 60*b* that supports the lower portion of the rod head 40*a*, whilst the main body side stays 64 comprises the first main body side stay 64*a* that supports the upper portion of the cylinder bottom (main body) 40*b* and the second main body side stay 64*b* that supports the lower portion of the cylinder bottom 40*b*. With this, it becomes possible to eliminate plays in the hydraulic cylinder 40 and to prevent the stays 60 and 64 from being bent or deformed, thereby enabling to further improve steering feel.

Figure 8:
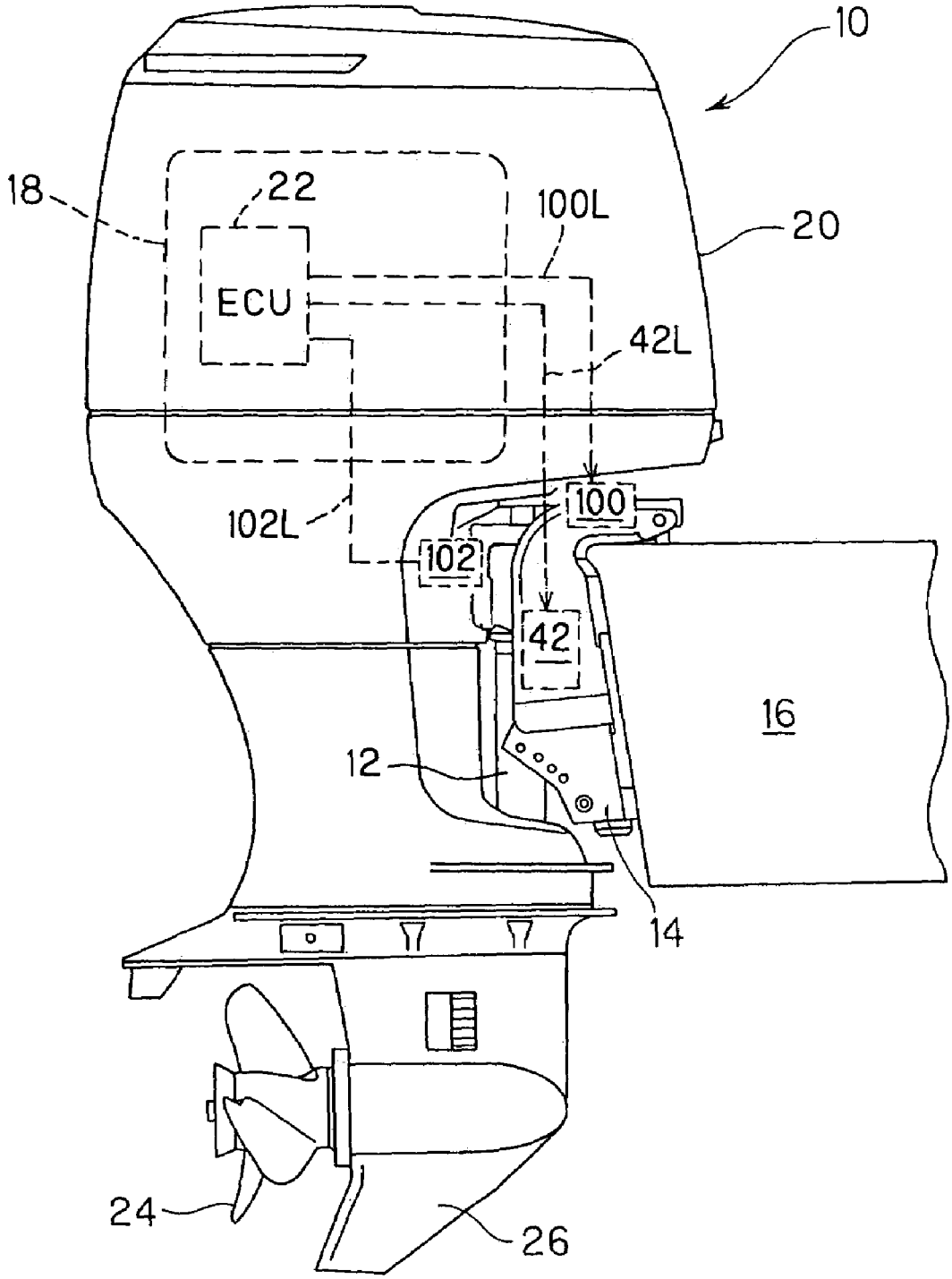
FIG. 8 is a view, similar to FIG. 2, but showing an outboard steering system according to a second embodiment of the invention.
Figure 9:
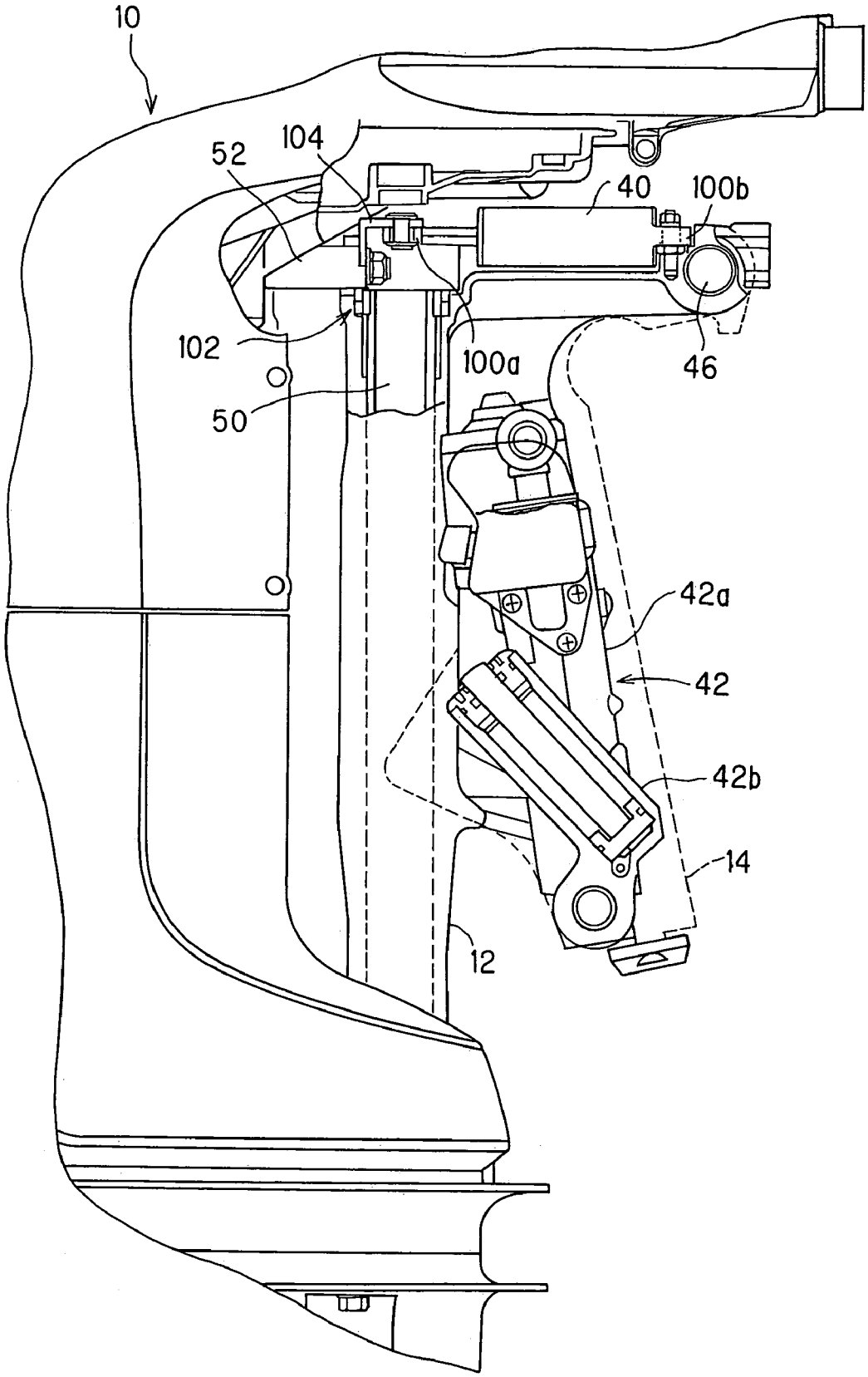
FIG. 9 is a view, similar to FIG. 3, but showing the swivel case illustrated in FIG. 8.

FIG. 8 is a view, similar to FIG. 2, but showing an outboard steering system according to a second embodiment of the invention, and FIG. 9 is a view, similar to FIG. 3, but showing the swivel case according to the second embodiment.

In the second embodiment, as shown in the figure, the recess 54 in the first embodiment is now removed, and a steering hydraulic cylinder 100 is installed at that upper portion directly on the swivel case 12. Specifically, a stay 104 is fastened to the mount frame 52 at a position near the uppermost of the swivel shaft 50 and an output end of the hydraulic cylinder 100, i.e., a rod head 100*a* of a piston rod of the hydraulic cylinder 100 is rotatably fixed to the stay 104. A main body of the hydraulic cylinder 100, i.e., a cylinder bottom 100*b* of the hydraulic cylinder 100 is rotatably fixed to the swivel case 12 directly at a position near the end (stern) of the boat 16.

Thus, the hydraulic cylinder 100 is installed at the upper portion of the swivel case 12 in such a manner that its one end (output end, i.e., the rod head 100*a*) is connected to the mount frame 52 (that generates angular displacement in the horizontal direction relative to the boat 16), whilst its other end (main body end, i.e., its cylinder bottom 100*b*) is connected to the swivel case 12 (that generates no angular displacement in the horizontal direction relative to the boat 16). Also, the hydraulic cylinder 100 is a double-acting hydraulic cylinder and is connected to a hydraulic pressure supplier including a hydraulic pump (not shown), hydraulic pressure circuit (not shown), etc., to be supplied with pressurized oil.

A rotation angle sensor 102 is installed at the swivel shaft 50 (not shown in the figure) and outputs a signal indicative of the angle of swivel shaft rotation. The output of the sensor 102 is sent to the ECU 22 over a signal line 102L.

Figure 10:
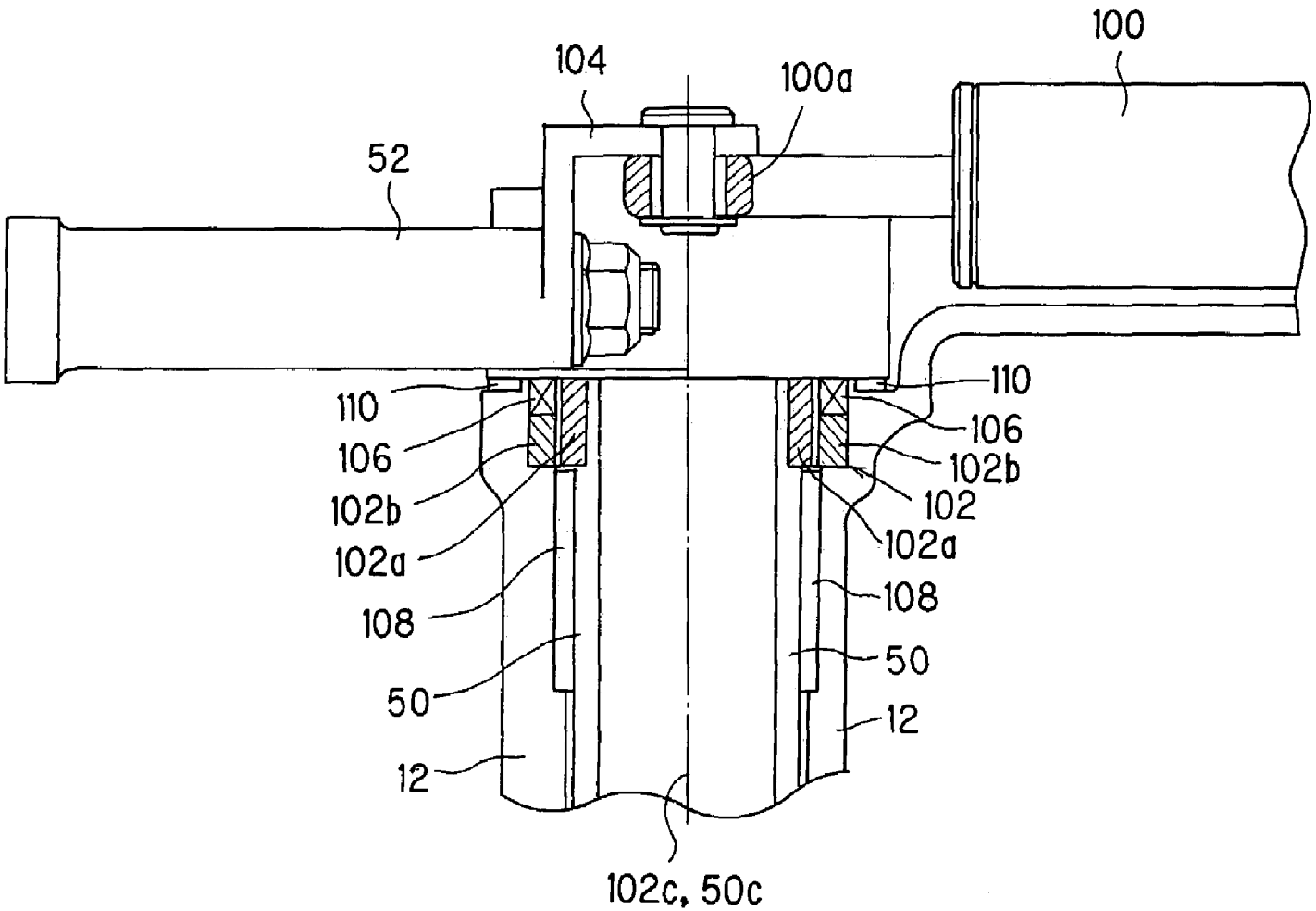
FIG. 10 is an enlarged partial cross-sectional view around a rotation angle sensor illustrated in FIG. 9.
Figure 11:
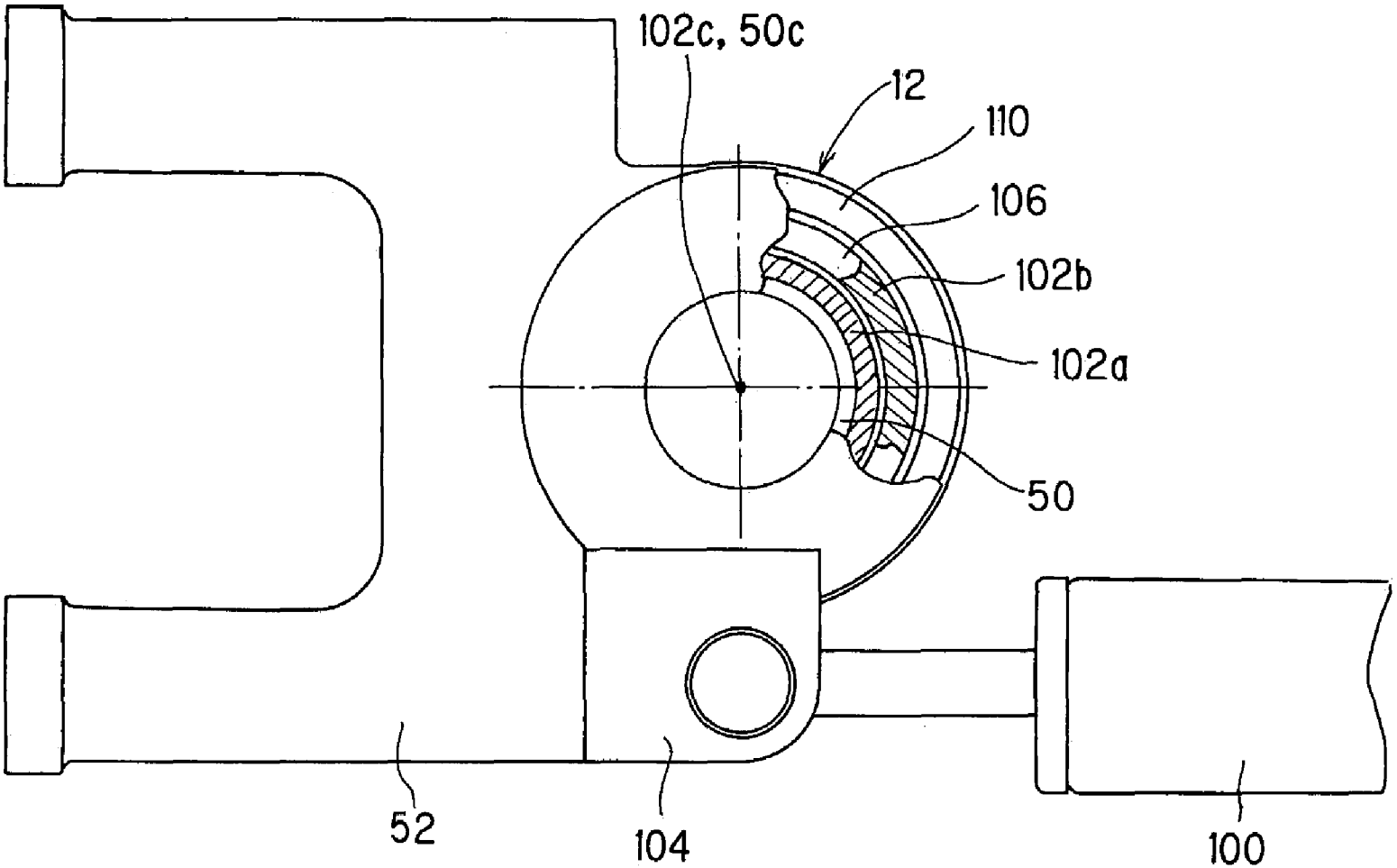
FIG. 11 is a plan view of the rotation angle sensor illustrated in FIG. 10.

FIG. 10 is an enlarged partial cross-sectional view around the rotation angle sensor 102 illustrated in FIG. 9, and FIG. 11 is a plan view of the rotation angle sensor 102 illustrated in FIG. 10.

Explaining the rotation angle sensor 102 with reference to the figures, it has a ring-like shape and comprises a group of magnets 102*a* and a group of detection coils 102*b* each gathered together to form a ring. Specifically, this rotation angle sensor 102 is installed at the swivel shaft 50 at a position immediately below (close to) the mount frame 52 and comprises the annular magnets 102*a* that are fixed to a recess formed at the outer surface of the swivel shaft 50 to be rotated therewith and the group of detection coils 102*b* that are fixed or rested at a recess formed at the inner wall of the swivel case 12 with a predetermined distance separated from the magnets 102*a*.

As best shown in FIG. 10, the swivel case 12 is made cylindrical, below the upper portion, to be coaxial with the swivel shaft 50 and the rotation angle sensor 102 of a ring-like shape is installed around the swivel shaft 50 in such a manner that a center 102*c* of the sensor 102 is equal to a center of rotation 50*c* of the swivel shaft 50. An annular seal member 106 is installed inside the swivel case 12 at a position between the detection coils 102*b* and the mount frame 52 in order that the sensor 102 is not exposed to the exterior and dust or sea water is prevented from entering through gaps between the swivel shaft 50 and the swivel case 12. At a position opposite to the annular seal member 106, a collar 108 of a similar shape is inserted in order that the sensor 102 is not exposed to the exterior and dust or sea water is prevented from entering from below, while carrying the swivel shaft 50. Reference numeral 110 indicates a washer that carries the mount frame 52.

Explaining the detection of the rotation angle sensor 102, since the swivel case 12 is a component that generates no angular displacement in the horizontal direction relative to the boat 16, a position of the magnets 102*a* relative to that of the detection coils 102*b* changes as the swivel shaft 50 rotates and the detection coils 102*b* produce current corresponding to a change in flux in response to the change of relative position. The current is inputted to the ECU 22 where the magnitude and direction of the angle of swivel shaft rotation are detected.

The ECU 22 determines or calculates the current supply command in such a manner that the error between the detected steering angle and the angle of swivel shaft rotation decreases to zero and outputs the same to the driver circuit of the electric motor (not shown) to drive the hydraulic pump through the hydraulic pressure circuit such that the outboard motor 10 is steered.

The rest of the configuration is the same as that of the first embodiment.

As stated above, in the outboard motor steering system according to the second embodiment, since the hydraulic cylinder 100 and the rotation angle sensor 102 are installed in the outboard motor, it becomes possible to prevent space utilization around the outboard motor and boat from being restricted.

Further, since the rotation angle sensor 102 is installed around the outer periphery (surface) of the swivel shaft 50, the detection accuracy is enhanced. Since the rotation angle sensor has a ring-like shape and is installed around the swivel shaft 50 in such a manner that the center 102*c* of the sensor 102 is equal to the center of rotation 50*c* of the swivel shaft 50, the detection accuracy is further enhanced. With this, since the outboard motor 10 is steered as desired by the operator, steering feel is further improved.

Further, since the rotation angle sensor 102 has the ring-like magnets 102*a* that are fixed to the outer surface of the swivel shaft 50 and the annular detection coils 102*b* that are fixed at the inner wall of the swivel case 12, this takes up less space for sensor installation. Since the sensor 102 is not exposed to the exterior by the seal member 106 and the collar 108, it is protected from being damaged by dust or salt in the sea water. Since the sensor 102 is fixed to the swivel case 12 and the swivel shaft 50 which are relatively rigid parts in the outboard motor 10, the positional relationship between the magnets 102*a* and the coils 102*b* is less likely to be out of order even when the outboard motor 10 experiences damage. This can further enhance the detection accuracy.

Figure 12:
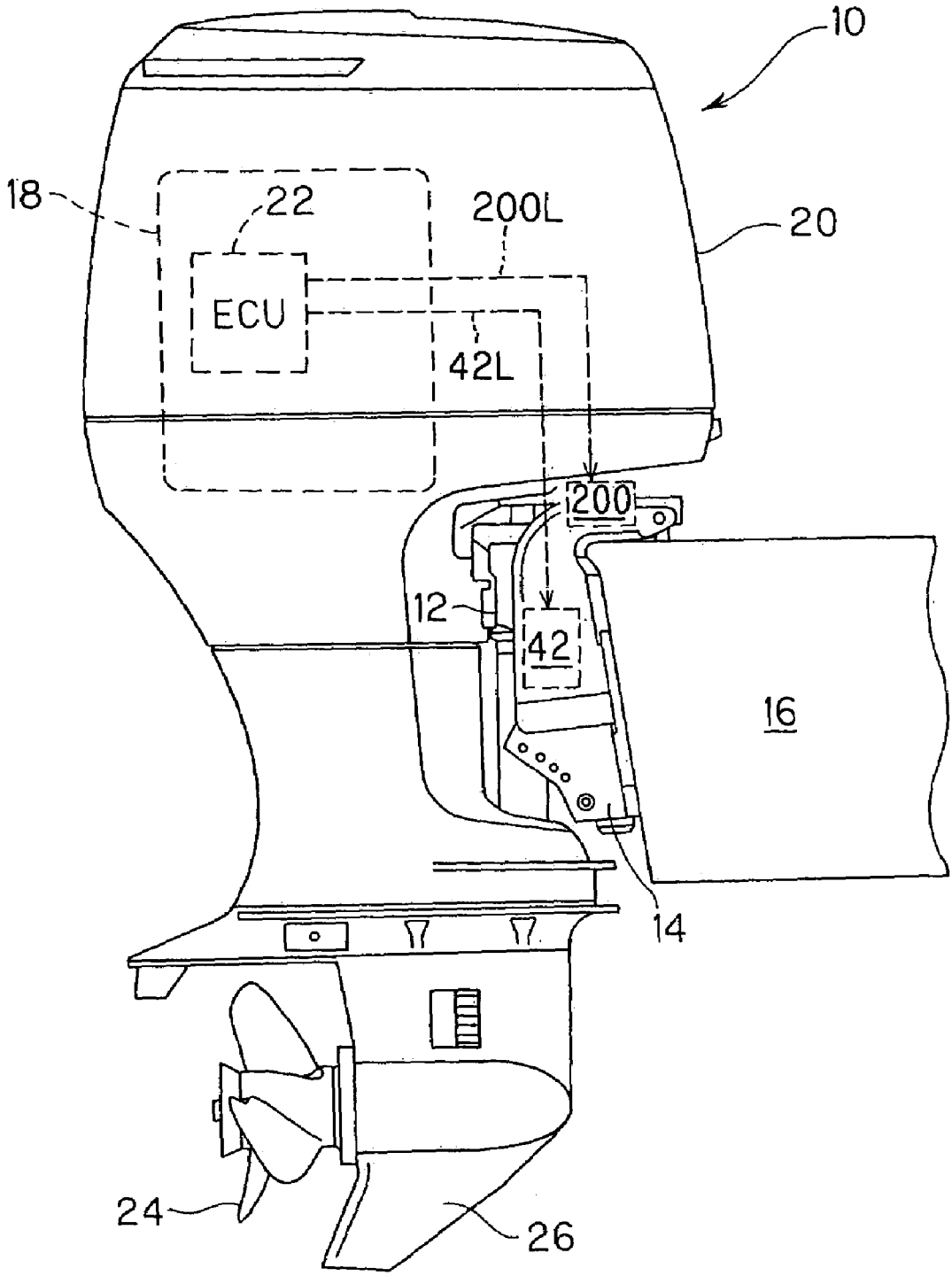
FIG. 12 is a view, similar to FIG. 2, but showing an outboard steering system according to a third embodiment of the invention.
Figure 13:
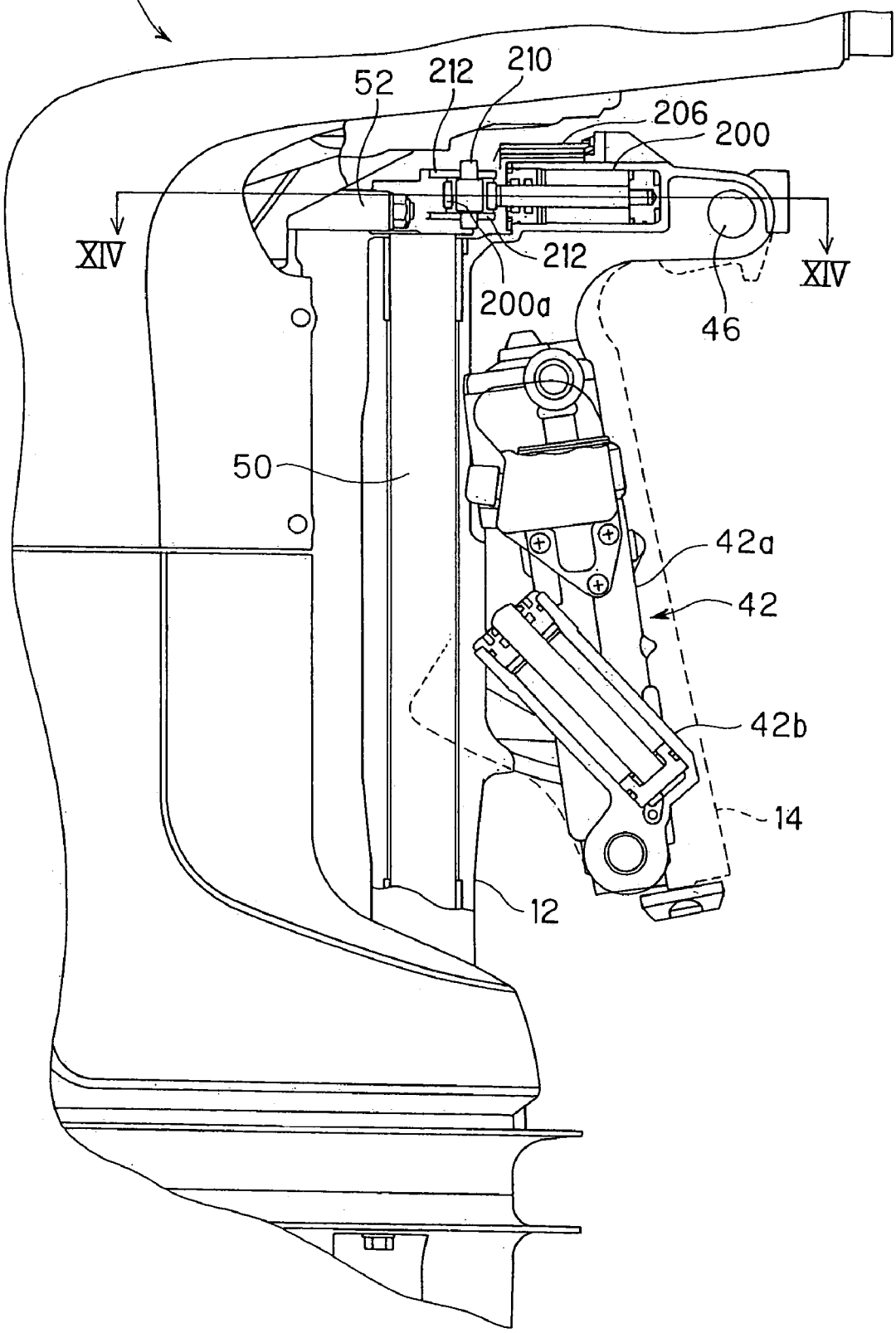
FIG. 13 is a view, similar to FIG. 3, but showing the swivel case (or thereabout) illustrated in FIG. 12.
Figure 14:
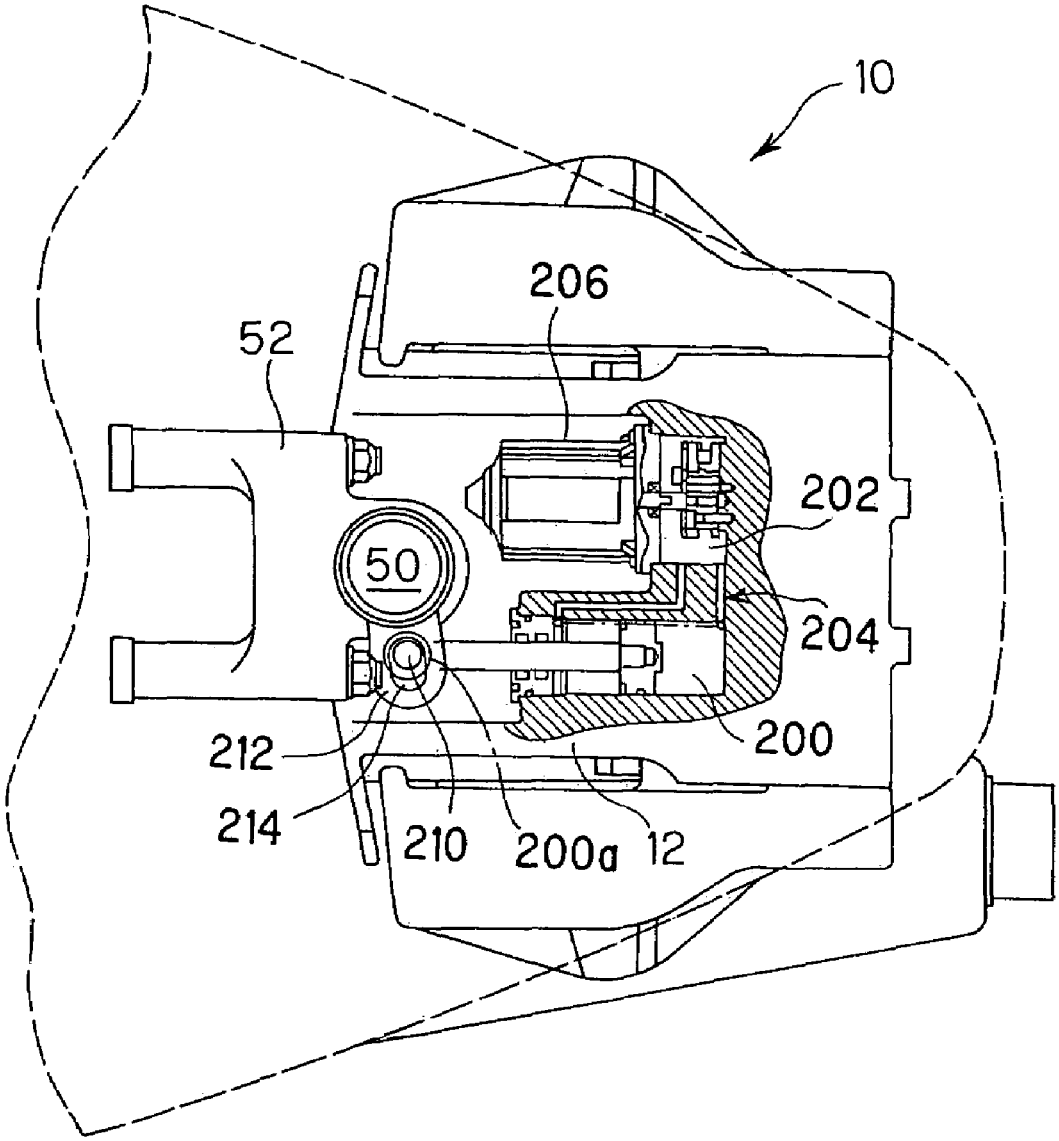
FIG. 14 is a cross-sectional view taken along the line XIV—XIV of FIG. 13.

FIG. 12 is a view, similar to FIG. 2, but showing an outboard steering system according to a third embodiment of the invention, FIG. 13 is a view, similar to FIG. 3 and also shows the swivel case 12 (or thereabout) illustrated in FIG. 12 and FIG. 14 is a cross-sectional view taken along the line XIV—XIV of FIG. 13.

In the third embodiment, as shown in the figure, the upper portion of the swivel case 12 is enlarged to provide a larger inner space in which a steering hydraulic cylinder 200 and a hydraulic pressure supplier including an hydraulic pressure circuit 204 (partially shown), an hydraulic pump 202 for supplying pressurized oil to the hydraulic cylinder 200 through the circuit 204, and an electric motor 206 for driving the pump 202, etc. are accommodated and fixed there. The electric motor 202 is connected to the ECU 22 through harness (not shown in FIGS. 13 and 14).

As illustrated in FIG. 14, the hydraulic cylinder 200 is a double-acting cylinder and is installed in the swivel case 12 such that its longitudinal direction is in parallel with that of the electric motor 206. The rod head (output end) 200*a* of a piston rod of the hydraulic cylinder 200 is connected to a cylindrical member 210 that has a side surface (cylindrical surface) in a direction that crosses the longitudinal direction of the hydraulic cylinder 200 at a right angle. A stay 212 is provided at the mount frame 52 near the uppermost or thereabout of the swivel shaft 50. The stay 212 comprises two plates located at upper and lower positions in the vertical direction and each having an elongated holes 214 penetrated therethrough. The cylindrical member 210 is inserted in the holes 214 movably such that the output end 200*a* of the hydraulic cylinder 200 is connected to the mount frame 52 through the stay 212.

When the operator steers the steering wheel 28, the amount of steering is detected by the steering angle sensor 30 and is inputted to the ECU 22. The ECU 22 determines or calculates the current supply command in response to the inputted amount of steering and outputs the same to the driver circuit of the electric motor 206 through the harness to drive the hydraulic pump 202 such that the hydraulic cylinder 200 extends or contracts. In response to the extension (or contraction) of the cylinder 200, the cylindrical member 210 (connected to the rod head 200*a*) moves in the elongated slots 214 of the stay 212, and translates the extension (or contraction) of the cylinder 200 to the rotation of the swivel shaft 50 through the mount frame 52.

Figure 15:
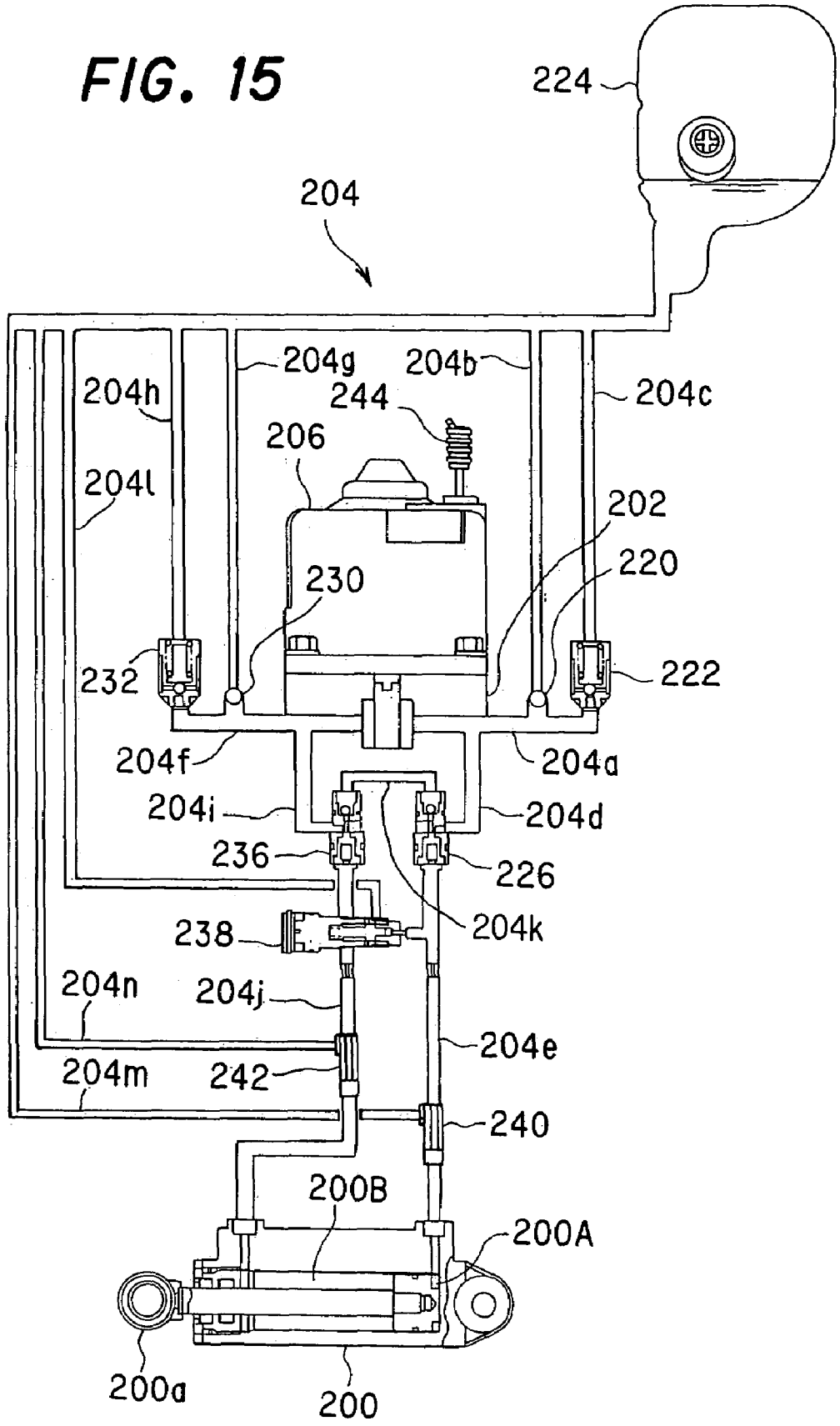
FIG. 15 is a circuit diagram of a hydraulic pressure circuit (hydraulic pressure supplier) illustrated in FIG. 14.

Next, the hydraulic pressure circuit 204 will be explained with reference to FIG. 15. FIG. 15 is a circuit diagram of a hydraulic pressure circuit (hydraulic pressure supplier) illustrated in FIG. 14.

As shown in the figure, the electric motor 206 is connected to the hydraulic pump 202. Specifically, the hydraulic pump 202 is a gear pump and is driven by the electric motor 206. The hydraulic pump 202 is connected, at one end, to a first check valve 220 and to a first relief valve 222 via an oil path 204*a*. The first check valve 220 and the first relief valve 222 are respectively connected to an oil tank (reservoir) 224 (where oil is reserved) via an oil path 204*b* and an oil path 204*c*.

Further, the hydraulic pump 202 is connected, at the one end, to a first switch valve 226, via an oil path 204*d*, that switches the direction of oil flow. Specifically, the first switch valve 226 is a pilot check valve whose primary side is connected to the oil path 204*d*, whilst whose secondary side is connected, via an oil path 204*e*, to a first oil chamber 200A of the hydraulic cylinder 200. The hydraulic pump 202 is connected, at the other end, to a second check valve 230 and to a second relief valve 232 via an oil path 204*f*. The second check valve 230 and the second relief valve 232 are respectively connected to the oil tank 224 via an oil path 204*g* and an oil path 204*h*. The hydraulic pump 202 is connected, at the other end, to a second switch valve 236, via an oil path 204*i* branched from the oil path 204*f*. Similarly to the first switch valve 226, the second switch valve 236 is a pilot check valve whose primary side is connected to the oil path 204*i*, whilst whose secondary side is connected, via the oil path 204*j*, to a second oil chamber 200B of the hydraulic cylinder 200. The pilot side of the second switch valve 236 is connected to that of the first switch valve 226 via an oil path 204*k*.

A manual valve (with a thermal valve) 238 and a first moving orifice 240 are provided in the oil path 204*e* that connects the first switch valve 226 to the first oil chamber 200A. The manual valve 238 and the first moving orifice 240 are respectively connected to the oil tank 224 via oil paths 2041 and 204*m*. A second moving orifice 242 is provided in the oil path 204*j* that connects the second switch valve 236 to the second oil chamber 200B. The second moving orifice 242 is connected to the tank 224 via an oil path 204*n*.

The operation of the hydraulic pressure supplier will then be explained with reference to the figure.

When the ECU 22 is inputted, through harness (now assigned with reference numeral 244) with the amount of steering indicating that the outboard motor 10 is to be steered right to turn the boat 16 left, the ECU 22 calculates the current supply command and supplies it to the electric motor 206 through the harness 244 such that it operates the hydraulic pump 202 to discharge pressurized oil in the oil path 204*a*.

When the hydraulic pump 202 is operated in this manner, oil reserved in the oil tank 224 flows along the line of the oil path 204*g*, the second check valve 230, the oil path 204*f*, the pump 202, the oil path 204*a* and the oil path 204*d*, and is supplied to the first switch valve 226. At this time, the first switch valve 226 connects the oil path 204*d* to the oil path 204*e* such that the pressurized oil flows into the first oil chamber 200A of the hydraulic cylinder 200. When the pressurized oil whose pressure is equal to or greater than a predetermined pressure acts on the pilot side of the second switch valve 236 through the oil path 204*k*, the second switch valve 236 connects the oil path 204*j* to the oil path 204*i* such that the second oil chamber 200B discharges the oil. With this, the hydraulic cylinder 200 is driven to the extension direction, thereby enabling the outboard motor 10 to be steered right by the swivel shaft 50.

On the other hand, when the ECU 22 is inputted with the amount of steering indicating that the outboard motor 10 is to be steered left to turn the boat 16 right, the ECU 22 calculates the current supply command and supplies it to the electric motor 206 to rotate in the opposite direction, i.e., it operates the hydraulic pump 202 to discharge the pressurized oil in the oil path 204*f*. As a result, the oil reserved in the oil tank 224 flows along the line of the oil path 204*b*, the first check valve 220, the oil path 204*a*, the pump 202, the oil path 204*f* and the oil path 204*i*, and is supplied to the second switch valve 236. With this, the second switch valve 236 connects the oil path 204*i* to the oil path 204*j* such that the pressurized oil flows into the second oil chamber 200B of the hydraulic cylinder 200.

When the pressurized oil whose pressure is equal to or greater than a predetermined pressure acts on the pilot side of the first switch valve 226 through the oil path 204*k*, the first switch valve 226 connects the oil path 204*e* to the oil path 204*d* such that the first oil chamber 200A discharges the oil. With this, the hydraulic cylinder 200 is driven to the contraction direction, thereby enabling the outboard motor 10 to be steered left by the swivel shaft 50.

When the hydraulic pressure supply to the first and second switch valves 226 and 236 is terminated, they disconnect the flow between the oil paths 204*d* and 204*e* and that between the oil paths 204*i* and 204*j* to prohibit oil from flowing out of the oil chambers 200A and 200B. With this, the hydraulic cylinder 200 is kept at that position and the outboard motor 10 holds the steered angle at that time. If the temperature in the oil path 204*e* rises beyond a prescribed temperature, the manual valve 238 opens to connect the oil path 204*e* to the oil tank 224 through an oil path 204*l*, thereby causing the temperature and hence, the pressure to drop to a permissible level.

In case that the boat 16 is to be steered while the engine 18 is stopped, the operator can steer the boat with the use of the steering wheel 28 by manually opening the manual valve 238 by hand.

As stated above, when the operator operates the electric motor 206 to drive the hydraulic pump 202 with the intention of turning the boat 16 in an opposite direction, the boat 16 can not change the direction due to inertia force exerting thereon. For this reason, in particular when the boat 16 is intended to turn quickly, the hydraulic pressure rises sharply and generates a large reaction force that acts on the electric motor 206. Since this reaction force is transmitted to the hydraulic cylinder 200 and other parts as an impact, it occasionally becomes difficult to turn the boat smoothly, thereby degrading the steering feel.

In view of this, in this embodiment, there are installed the first moving orifice (hydraulic pressure reliever) 240, the second moving orifice (hydraulic pressure reliever) 242 and the oil path 204*m* and 204*n* that connect them to the oil tank 224 as hydraulic pressure reliever such that excessive hydraulic pressure is relieved or reduced.

Figure 16:
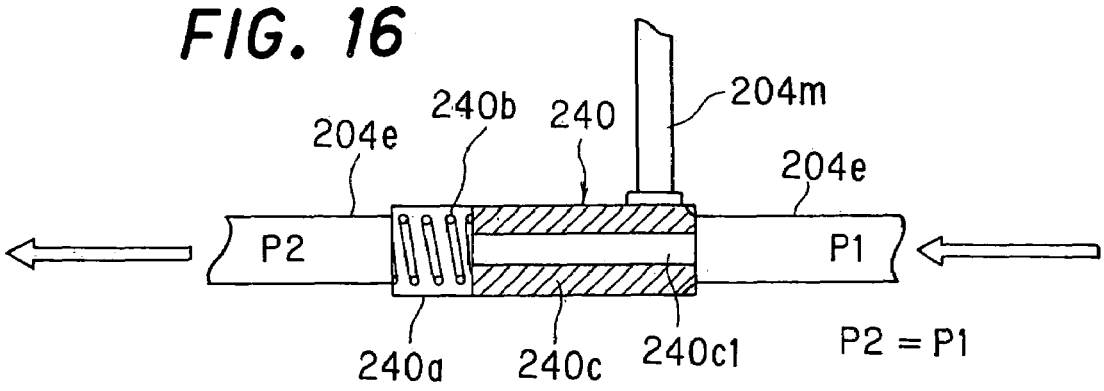
FIG. 16 is an enlarged explanatory view showing a first moving orifice illustrated in FIG. 15.
Figure 17:
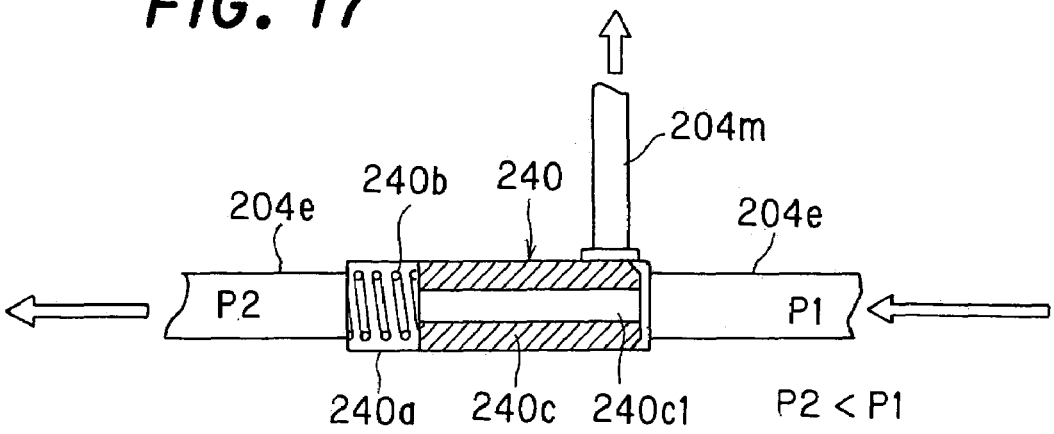
FIG. 17 is an enlarged explanatory view similarly showing the first moving orifice illustrated in FIG. 15.
Figure 18:
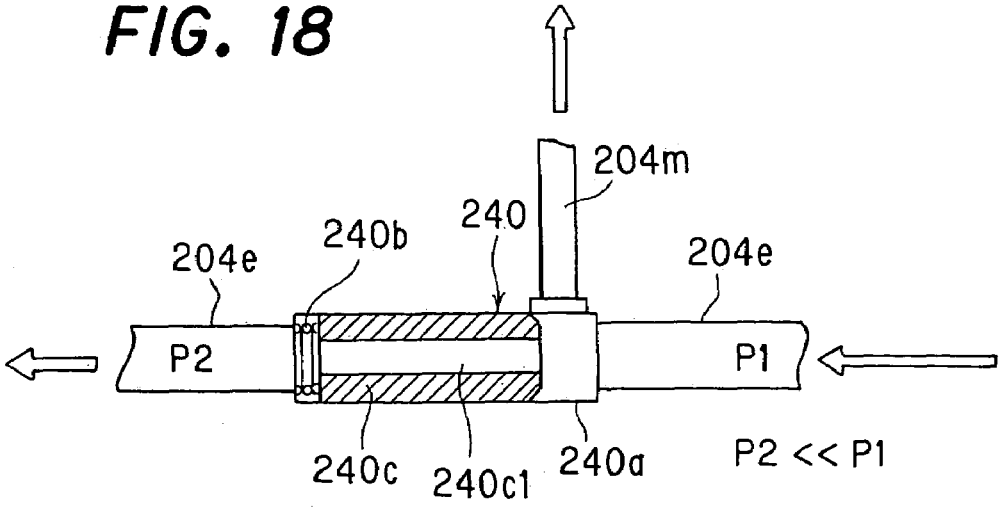
FIG. 18 is an enlarged explanatory view similarly showing the first moving orifice illustrated in FIG. 15.

FIGS. 16 to 18 are an enlarged explanatory views each showing the first moving orifice 240.

The operation of the first moving orifice 240 will be explained taking a case that the outboard motor 10 is steered right so quickly that hydraulic (oil) pressure rises sharply in the hydraulic pressure circuit. In the figures, for ease of understanding, the direction and amount of flow of oil are schematically shown by those of arrows.

As illustrated in the figures, the first moving orifice 240 comprises a cylindrical casing 240*a* installed in the oil path 240*e*, a spring 240*b* installed in the casing 240*a* at a downstream side (the side close to the hydraulic cylinder 200 shown in FIG. 15), and a cylindrical moving member 240*c* fitted in the casing 240*a* without gap therebetween but movably and urged by the spring 240*b* towards an upstream side (the side close to the hydraulic pump 202 shown in FIG. 15). The casing 240*a* is connected to the oil path 204*m* at its end at the upstream side. The moving member 240*c* is bored and a hole 240*c*1 is formed therethrough. The cross-sectional area of the hole 240*c*1 is set to a predetermined value that is less than the cross-sectional area of the oil path 204*e*.

As illustrated in FIG. 16, when an upstream side pressure P1 is equal or almost equal to a downstream side pressure P2 in the first moving orifice 240 installed in the oil path 204*e*, in other words when the outboard motor 10 is not steered or is steered moderately, the moving member 240*c* is urged by the spring 240*b* towards the upstream side of the casing 240*a*.

Then, when a large amount of oil begins to flow into the first oil chamber 200A in response to the sharp steering to the right, since the pressure in the oil path 204*e* begins to rise abruptly, the upstream pressure P1 exceeds the downstream pressure P2. As a result, as illustrated in FIG. 17, the moving member 240*c* is being pushed towards the downstream side against the spring force. With this, a portion connecting the oil path 204*m* to the casing 240*a* begins to open to communicate the oil path 204*e* to the oil path 204*m* and oil supplied from the upstream of the first moving orifice 240 begins to return to the oil tank 224 via the oil path 204*m*.

Here, what is meant by "pressure rises sharply" is more precisely that change of pressure per unit time exceeds a predetermined value. The predetermined value is a value indicative of a pressure change at which the moving member 240*c* begins to move, and is determined by a difference in cross-sectional area between the hole 240*c*1 and the oil path 204*e*, the length of the hole 240*c*1 and urging force of the spring 204*b*, etc.

As shown in FIG. 18, as the difference between P1 and P2 grows, in other words, as the pressure rise in the oil path 204*e* becomes more sharp, the movement of the moving member 240*c* increases such that the amount of oil to be returned to the oil tank 224 through the oil path 204*m* increases. More specifically, the more sharply oil pressure in the oil path connecting the hydraulic pump 202 to the first oil chamber 200A rises, the more amount of oil is returned to the oil tank 224, thereby relieving or reducing excessive hydraulic (oil) pressure. With this, even if the outboard motor 10 is steered right quickly, oil pressure does not rise sharply and the disadvantages mentioned above can be effectively avoided. As will be understood from the above, the amount of oil to be returned to the oil tank 224 can be easily regulated by changing the predetermined value by, for example, changing the cross-sectional area of the hole 240*c*1, urging force of the spring 240*b*, etc.

Then, the operation of the second moving orifice 240 will be explained taking a case that the outboard motor 10 is steered left so quickly that hydraulic (oil) pressure rises sharply in the hydraulic pressure circuit, with reference to FIGS. 19 to 21 that are an enlarged explanatory views showing the second moving orifice 242.

As illustrated in the figures, similar to the first moving orifice 240, the second moving orifice 242 comprises a cylindrical casing 242*a* installed in the oil path 204*j*, a spring 242*b* installed in the casing 242*a* at a downstream side (the side close to the hydraulic cylinder 200 shown in FIG. 15), and a cylindrical moving member 242*c* fitted in the casing 242*a* without gap therebetween but movably and urged by the spring 242*b* towards an upstream side (the side close to the hydraulic pump 202 shown in FIG. 15). The casing 242*a* is connected to an oil path 204*n* at its end at the upstream side. The moving member 242*c* is bored and a hole 242*c*1 is formed therethrough. The cross-sectional area of the hole 242*c*1 is set to a predetermined value that is less than the cross-sectional area of the oil path 204*j*.

Figure 19:
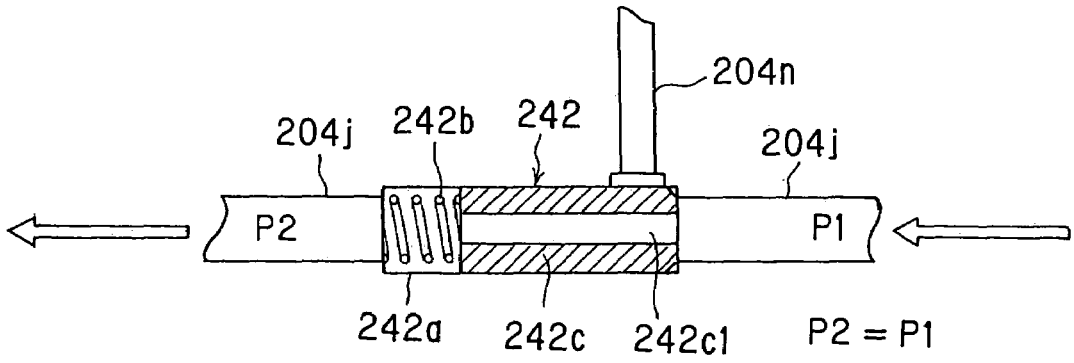
FIG. 19 is an enlarged explanatory view showing a second moving orifice illustrated in FIG. 15.
Figure 20:
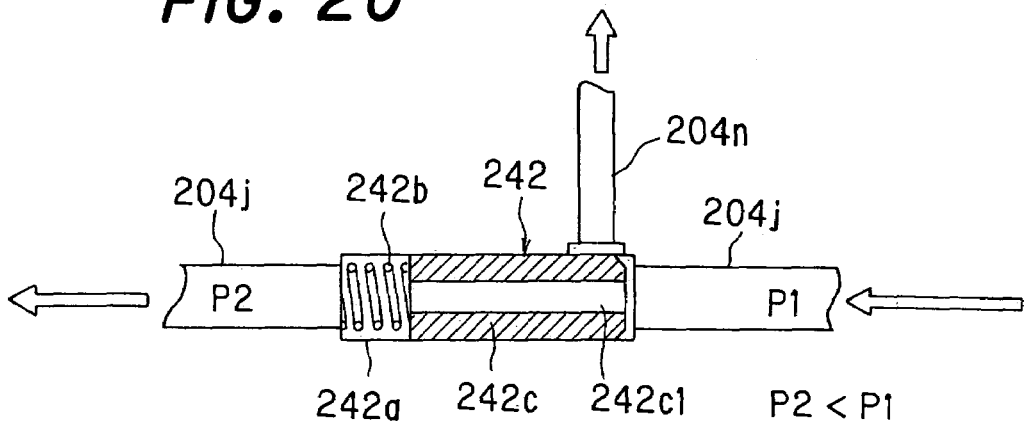
FIG. 20 is an enlarged explanatory view similarly showing the second moving orifice illustrated in FIG. 15.

As illustrated in FIG. 19, when an upstream side pressure P1 is equal or almost equal to a downstream side pressure P2 in the second moving orifice 242 in the oil path 204*j*, the moving member 242*c* is urged by the spring 242*b* towards the upstream side of the casing 242*a*. Then, when a large amount of oil begins to flow into the second oil chamber 200B in response to the sharp steering to the left, since the pressure in the oil path 204*j* begins to rise abruptly, the upstream pressure P1 exceeds the downstream pressure P2. As a result, as illustrated in FIG. 20, the moving member 242*c* is being pushed towards the downstream side against the spring force. With this, a portion connecting the oil path 204*n* to the casing 242*a* begins to open to communicate the oil path 204*j* to the oil path 204*n* and oil supplied from the upstream of the second moving orifice 242 begins to return to the oil tank 224 via the oil path 204*n*.

Figure 21:
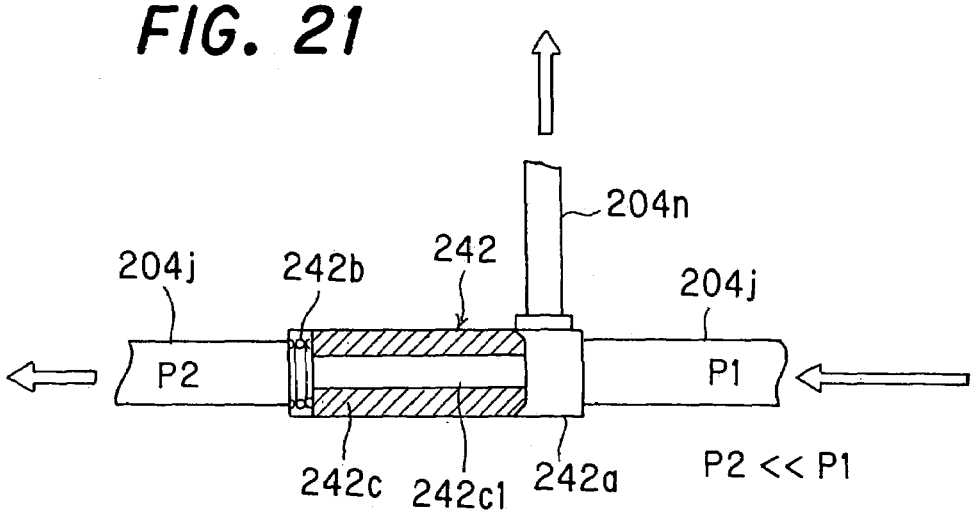
FIG. 21 is an enlarged explanatory view similarly showing the second moving orifice illustrated in FIG. 15.

As shown in FIG. 21, the more sharply oil pressure in the oil path from the hydraulic pump 202 to the second oil chamber 200B rises, the more amount of oil is returned to the oil tank 224, thereby relieving or reducing excessive hydraulic (oil) pressure. With this, even if the outboard motor 10 is steered left quickly, hydraulic (oil) pressure does not rise sharply and the disadvantages mentioned above can be effectively avoided. Similar to the first moving orifice 240, the amount of oil to be returned to the oil tank 224 can be easily regulated by changing the predetermined value by, for example, changing the cross-sectional area of the hole 242*c*1, urging force of the spring 242*b*, etc.

As stated above, in the outboard motor steering system according to the third embodiment, since the first and second moving orifices 240 and 242 are provided in the hydraulic pressure circuit (as the hydraulic pressure relievers) which supplies hydraulic (oil) pressure to the hydraulic cylinder 200 (that rotates the swivel shaft 50 for steering) such that oil is returned to the oil tank 224 to relieve or reduce hydraulic pressure when hydraulic pressure rises sharply. With this, even when the outboard motor 10 is steered right or left sharply, since hydraulic pressure does not rise sharply, the operator can steer or turn the boat 16 smoothly and hence, the steering feel is improved.

Further, since the hydraulic pressure relievers comprise the first and second moving orifices 240 and 242 that can be simply installed in the hydraulic pressure circuit, the structure is simplified.

Further, the extent of pressure decrease or relief can be easily regulated by changing the cross-sectional area of the holes 240*c*1 and 242*cl*, the urging force of the spring 240*b* and 242*b*, etc.

The rest of the configuration is the same as that of the foregoing embodiments.

It should be noted that the hydraulic pressure supplier including the hydraulic circuit 204 can be also applied to the first and second embodiments.

Thus, the first to three embodiments are arranged to have a steering system for an outboard motor 10 mounted on a stern of a boat 16 and having an internal combustion engine 18 at its upper portion and a propeller 24 with a rudder 26 at its lower portion powered by the engine to propel and steer the boat, comprising: a swivel shaft 50 connected to the propeller to turn the propeller relative to the boat; an actuator (hydraulic cylinder 40) connected to the swivel shaft to rotate the swivel shaft; and a swivel case 12 rotatably accommodating the swivel shaft, the swivel case being formed with a recess 54 having a box-like shape to accommodate the actuator therein in such a manner that the actuator does not project outside a profile 80 of the outboard motor, obtained by looking down the outboard motor from the above in the vertical direction, regardless of a steered angle of the outboard motor.

In the system, the actuator (hydraulic cylinder 40) is accommodated in the recess 54 in such a manner that a longitudinal direction of the actuator is positioned on a diagonal of a rectangle of the recess.

In the system, the actuator (hydraulic cylinder 40) is accommodated in the recess 54 by supported by supports (stays 60, 64) comprising a first support (60*a*, 64*a*) that supports the actuator at its upper portion thereof and a second support (60*b*, 64*b*) that supports the actuator at its lower portion thereof.

The system further includes: a rotation angle sensor 44 outputting a signal indicative of an angle of rotation of the swivel shaft; and a controller (ECU 22) controlling operation of the actuator based on at least the signal of the rotation angle sensor; and wherein the rotation angle sensor 44 is installed in the recess.

The system further includes: a rotation angle sensor 102 that outputs a signal indicative of an angle of rotation of the swivel shaft; and a controller (ECU 22) that controls operation of the actuator based on at least the signal of the rotation angle sensor; and wherein the rotation angle sensor 102 is installed around an outer periphery of the swivel shaft 50.

In the system, the rotation angle sensor 102 has a ring-like shape and is installed around the outer periphery of the swivel shaft 50 in such a manner that a center 102*c* of the rotation angle sensor 102 is made equal to a center of rotation 50*c* of the swivel shaft 50.

In the system, the rotation angle sensor 102 comprises magnets 102*a* having a ring-like shape fastened to the outer periphery of the swivel shaft and a detection coil 102*b* fastened to an inner periphery of the swivel case.

In the system, the actuator is a hydraulic cylinder 40, 200 and including: a hydraulic pressure supplier (hydraulic pressure circuit 204, etc.) that supplies hydraulic pressure to the hydraulic cylinder 200; and a hydraulic pressure reliever that relieves hydraulic pressure when change of hydraulic pressure of the hydraulic pressure supplier exceeds a predetermined value. The hydraulic pressure reliever comprises: a moving orifice (first moving orifice 240 and second moving orifice 242) installed in the hydraulic pressure supplier; and a relief oil path 204*m* and 204*n* installed in the hydraulic pressure supplier connecting hydraulic pressure to an oil tank.

Further, the first to three embodiments are arranged to have a steering system for an outboard motor 10 mounted on a stern of a boat 16 and having an internal combustion engine 18 at its upper portion and a propeller 24 with a rudder 26 at its lower portion powered by the engine to propel and steer the boat, comprising: a swivel shaft 50 connected to the propeller to turn the propeller relative to the boat; an actuator (hydraulic cylinder 100) connected to the swivel shaft to rotate the swivel shaft; a rotation angle sensor 102 installed around an outer periphery of the swivel shaft 50 and outputting a signal indicative of an angle of rotation of the swivel shaft; and a controller (ECU 22) that controls operation of the actuator based on at least the signal of the rotation angle sensor.

In the system, the rotation angle sensor 102 has a ring-like shape and is installed around the outer periphery of the swivel shaft 50 in such a manner that a center 102*c* of the rotation angle sensor is made equal to a center of rotation 50*c* of the swivel shaft 50. The rotation angle sensor comprises magnets 102*a* having a ring-like shape fastened to the outer periphery of the swivel shaft 50 and a detection coil 102*b* fastened to an inner periphery of the swivel case 12.

The system further includes: a swivel case 12 rotatably accommodating the swivel shaft 50 and being formed with a recess 54 to accommodate the actuator (hydraulic cylinder 40) therein in such a manner that the actuator does not project outside a profile of the outboard motor, obtained by looking down the outboard motor from downward in the vertical direction, regardless of a steered angle of the outboard motor. The swivel case 12 is formed with the recess 54 having a box-like shape to accommodate the actuator therein in such a manner that a longitudinal direction of the actuator is positioned on a diagonal of a rectangle of the recess. The actuator is accommodated in the recess by supported by supports (stays 60, 64) comprising a first support (60*a*, 64*a*) that supports the actuator at its upper portion thereof and a second support (64*a*, 64*b*) that supports the actuator at its lower portion thereof.

In the system, actuator is a hydraulic cylinder 200 and including: a hydraulic pressure supplier (hydraulic pressure circuit 204, etc.) that supplies hydraulic pressure to the hydraulic cylinder; and a hydraulic pressure reliever that relieves hydraulic pressure when change of hydraulic pressure of the hydraulic pressure supplier exceeds a predetermined value. The hydraulic pressure reliever comprises: a moving orifice (first moving orifice 240 and second moving orifice 242) installed in the hydraulic pressure supplier; and a relief oil path 204*m* and 204*n* installed in the hydraulic pressure supplier connecting hydraulic pressure to an oil tank.

Further, the first to three embodiments are arranged to have a steering system for an outboard motor 10 mounted on a stern of a boat 16 and having an internal combustion engine 18 at its upper portion and a propeller 24 with a rudder 26 at its lower portion powered by the engine to propel and steer the boat, comprising: a swivel shaft 50 connected to the propeller to turn the propeller relative to the boat; a hydraulic actuator (cylinder) 40 connected to the swivel shaft to rotate the swivel shaft; a hydraulic pressure supplier (hydraulic pressure circuit 204, etc.) that supplies hydraulic pressure to the hydraulic actuator; and a hydraulic pressure reliever that relieves hydraulic pressure when change of hydraulic pressure of the hydraulic pressure supplier exceeds a predetermined value. The hydraulic pressure reliever comprises: a moving orifice (first moving orifice 240 and second moving orifice 242) installed in the hydraulic pressure supplier; and a relief oil path 204*m* and 204*n* installed in the hydraulic pressure supplier connecting hydraulic pressure to an oil tank.

The system further includes: a swivel case 12 rotatably accommodating the swivel shaft 50 and being formed with a recess 24 to accommodate the hydraulic actuator therein in such a manner that the hydraulic actuator does not project outside a profile of the outboard motor, obtained by looking down the outboard motor from downward in the vertical direction, regardless of a steered angle of the outboard motor.

In the system, the swivel case 12 is formed with the recess 54 having a box-like shape to accommodate the hydraulic actuator therein in such a manner that a longitudinal direction of the hydraulic actuator is positioned on a diagonal of a rectangle of the recess. The hydraulic actuator is accommodated in the recess 54 by supported by supports (stays 60, 64) comprising a first support (60*a*, 64*a*) that supports the hydraulic actuator at its upper portion thereof and a second support (60*b*, 64*b*) that supports the hydraulic actuator at its lower portion thereof.

The system further includes: a rotation angle sensor 44 outputting a signal indicative of an angle of rotation of the swivel shaft; and a controller (ECU 22) controlling operation of the hydraulic actuator based on at least the signal of the rotation angle sensor; and wherein the rotation angle sensor is installed in the recess 54.

The system further includes: a rotation angle sensor 102 that outputs a signal indicative of an angle of rotation of the swivel shaft; and a controller (ECU 22) that controls operation of the hydraulic actuator based on at least the signal of the rotation angle sensor; and wherein the rotation angle sensor 102 is installed around an outer periphery of the swivel shaft 50. The rotation angle sensor 102 has a ring-like shape and is installed around the outer periphery of the swivel shaft 50 in such a manner that a center 102*c* of the rotation angle sensor is made equal to a center of rotation 50*c* of the swivel shaft 50. The rotation angle sensor 102 comprises magnets 102*a* having a ring-like shape fastened to the outer periphery of the swivel shaft and a detection coil 102*b* fastened to an inner periphery of the swivel case.

It should be noted in the above that the first to third embodiments can be combined together as stated immediately above. For example, the hydraulic 100 cylinder can be installed in the recess 54 as described in the first embodiment, whilst the rotation angle sensor 102 can be installed around the swivel shaft 50. As mentioned above, the hydraulic pressure supplier including the hydraulic circuit 204 can be also applied to the first and second embodiments.

It should also be noted in the above that, although the hydraulic cylinder is used as the actuator to rotate the swivel shaft 50, the invention should not be limited thereto and an electric motor or some similar factors may be used as the actuator.

The entire disclosure of Japanese Patent Application Nos. 2003-40833, 20030-40834 and 2003-40836, all filed on Feb. 19, 2003, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A steering system for pivoting an outboard motor mounted on a stern of a boat, said outboard motor having an internal combustion engine disposed inside of and fixed with respect to an engine cover at its upper portion and a propeller with a rudder at its lower portion powered by the engine to propel and steer the boat, comprising:

a swivel shaft installed in the outboard motor;

an actuator connected to the swivel shaft to rotate the swivel shaft; and a swivel case rotatably accommodating the swivel shaft, the swivel case being formed with a recess having a box-like shape to accommodate the actuator therein in such a manner that the actuator does not project outside a profile of the outboard motor for all possible steered angles of the outboard motor, wherein said profile is obtained by looking down the outboard motor from above in the vertical direction.

2. A system according to claim 1, wherein the actuator is accommodated in the recess in such a manner that a longitudinal direction of the actuator is positioned on a diagonal of a rectangle of the recess.

3. A system according to claim 1, wherein the actuator is accommodated in the recess by supports comprising a first support that supports the actuator at head end thereof and a second support that supports the actuator at bottom end thereof.

4. A system according to claim 1, further including: a rotation angle sensor outputting a signal indicative of an angle of rotation of the swivel shaft; and a controller controlling operation of the actuator based on at least the signal of the rotation angle sensor; and wherein the rotation angle sensor is installed in the recess.

5. A system according to claim 1, further including:

a rotation angle sensor that outputs a signal indicative of an angle of rotation of the swivel shaft; and a controller that controls operation of the actuator based on at least the signal of the rotation angle sensor; and wherein the rotation angle sensor is installed around an outer periphery of the swivel shaft.

6. A system according to claim 5, wherein the rotation angle sensor has a ring-like shape and is installed around the outer periphery of the swivel shaft in such a manner that a center of the rotation angle sensor is made equal to a center of rotation of the swivel shaft.

7. A system according to claim 5, wherein the rotation angle sensor comprises magnets having a ring-like shape fastened to the outer periphery of the swivel shaft and a detection coil fastened to an inner periphery of the swivel case.

8. A system according to claim 1, wherein the actuator is a hydraulic cylinder and including:

a hydraulic pressure supplier that supplies hydraulic pressure to the hydraulic cylinder; and a hydraulic pressure reliever that relieves hydraulic pressure when change of hydraulic pressure of the hydraulic pressure supplier exceeds a predetermined value.

9. A system according to claim 8, wherein the hydraulic pressure reliever comprises:

a moving orifice installed in the hydraulic pressure supplier; and a relief oil path installed in the hydraulic pressure supplier connecting hydraulic pressure to an oil tank.

10. A steering system for an outboard motor mounted on a stern of a boat and having an internal combustion engine at its upper portion and a propeller with a rudder at its lower portion powered by the engine to propel and steer the boat, comprising:

a swivel shaft installed in the outboard motor;

an actuator connected to the swivel shaft to rotate the swivel shaft;

a rotation angle sensor installed around an outer periphery of the swivel shaft and outputting a signal indicative of an angle of rotation of the swivel shaft, wherein the rotation angle sensor has a ring-like shape and is installed around the outer periphery of the swivel shaft in such a manner that a center of the rotation angle sensor is made equal to a center of rotation of the swivel shaft, and further wherein the rotation angle sensor comprises magnets having a ring-like shape fastened to the outer periphery of the swivel shaft and a detection coil fastened to an inner periphery of the swivel case; and a controller that controls operation of the actuator based on at least the signal of the rotation angle sensor.

11. A system according to claim 10,further including:

a swivel case accommodating the swivel shaft and being formed with a recess to accommodate the actuator therein in such a manner that the actuator does not project outside a profile of the outboard motor, obtained by looking down the outboard motor from above in the vertical direction, regardless of a steered angle of the outboard motor.

12. A system according to claim 11, wherein the swivel case is formed with the recess having a box-like shape to accommodate the actuator therein in such a manner that a longitudinal direction of the actuator is positioned on a diagonal of a rectangle of the recess.

13. A system according to claim 11, wherein the actuator is accommodated in the recess by supports comprising a first support that supports the actuator at its upper portion thereof and a second support that supports the actuator at its lower portion thereof.

14. A system according to claim 10, wherein the actuator is a hydraulic cylinder and including:

a hydraulic pressure supplier that supplies hydraulic pressure to the hydraulic cylinder; and a hydraulic pressure reliever that relieves hydraulic pressure when change of hydraulic pressure of the hydraulic pressure supplier exceeds a predetermined value.

15. A system according to claim 14, wherein the hydraulic pressure reliever comprises:

a moving orifice installed in the hydraulic pressure supplier; and a relief oil path installed in the hydraulic pressure supplier connecting hydraulic pressure to an oil tank.

* * * * *